US011776360B2

(12) United States Patent
Machwirth et al.

(10) Patent No.: US 11,776,360 B2
(45) Date of Patent: Oct. 3, 2023

(54) GAMING DEVICES AND METHODS FOR OPERATING A GAMING DEVICE

(71) Applicant: Novomatic AG, Gumpoldskirchen (AT)

(72) Inventors: Harald Machwirth, Hargesheim (DE); Christian Ozga, Appenheim (DE)

(73) Assignee: Novomatic AG, Gumpoldskirchen (AT)

( * ) Notice: Subject to any disclaimer, the term of this patent is extended or adjusted under 35 U.S.C. 154(b) by 51 days.

(21) Appl. No.: 17/555,248

(22) Filed: Dec. 17, 2021

(65) Prior Publication Data

US 2023/0196878 A1 Jun. 22, 2023

(51) Int. Cl.
*G07F 17/32* (2006.01)

(52) U.S. Cl.
CPC ..... *G07F 17/3267* (2013.01); *G07F 17/3209* (2013.01); *G07F 17/3213* (2013.01); *G07F 17/3258* (2013.01)

(58) Field of Classification Search
None
See application file for complete search history.

(56) References Cited

U.S. PATENT DOCUMENTS 11,107,314 B2 * 8/2021 Tam ..... G07F 17/3244
2004/0048662 A1 3/2004 Ulmer
2008/0227523 A1 9/2008 Vallejo et al.
2009/0124361 A1 * 5/2009 Gilmore ..... G07F 17/3262 463/26
2023/0050242 A1 * 2/2023 Bouvier ..... G07F 17/34

OTHER PUBLICATIONS

"Play Black Hole Slot" by SlotCatalog.com. [online], [dated May 29, 2019], [retrieved on Apr. 20, 2023]. <URL:https://slotcatalog.com/en/slots/Black-Hole>. 5 Pages. (Year: 2019).*
"Black Hole—Play for 100% Free in Demo Mode by Merkur Slots" by TempleofSlots.com. [online], [retrieved on Apr. 20, 2023]. <URL:https://templeofslots.com/game/black-hole-slot-demo-play-free>. 5 Pages. (Year: 2023).*
(Continued)

*Primary Examiner* — Milap Shah
(74) *Attorney, Agent, or Firm* — EIP US LLP

(57) ABSTRACT

Various examples relate to a gaming device. The gaming device comprises a control arrangement. The control arrangement comprises interface control circuitry, credit meter control circuitry, and at least one processor and a memory arrangement for storing a plurality of instructions, which when executed by the at least one processor, causes the control arrangement to: cause play of a game comprising a display of a plurality of symbols at a plurality of symbol display positions of a plurality of reels, and display of a plurality of progression structures, wherein a progression structure comprises a plurality of steps, wherein each step is associated with a step credit value; receive, via the interface control circuitry, credit value transfer information for causing a user-initiated update of a progression structure of the plurality of progression structures; and cause the user-initiated update of the selected progression structure and the credit meter based on the credit value transfer information.

15 Claims, 22 Drawing Sheets

The player COLLECTS step S2 from ladder 109C and steps S1, S2, S3 from ladder 109A!

The collected step credit value of $4.90 has been added to the credit balance 112.

The step credit balance 116 has been updated to $8.80.

(56) References Cited

OTHER PUBLICATIONS

"Black Hole—Instructions" from "Black Hole—Play for 100% Free in Demo Mode by Merkur Slots" by TempleofSlots.com. [online], [ retrieved on Apr. 20, 2023]. <URL:https://templeofslots.com/game/black-hole-slot-demo-play-free>. 5 Pages. (Year: 2023).*
ADP Gauselmann: Sep. 19, 2020, "Magic Monk Rasputin—Big Win Rush", https://www.youtube.com/watch?v=0BEulbvt660.
ADP Gauselmann: Oct. 5, 2021, "A New attempt to Crack Green Amulet! Risk game Mercury Magic! Gamble until the Towers Glow!", https://www.youtube.com/watch?v=GecvCvCDeWg.
ADP Gauselmann: Jul. 5, 2018, "Merkur Magie Black Hole", https://www.youtube.com/watch?v=0kwYu3-5pHk.
Merkur: Sep. 12, 2020, "The 80 Days Travel risk game Merkur Magic in a € 2 slot! Tr5 casino gambling", https://www.youtube.com/watch?v=qfXjrGOgjy4.
Novomatic: Joker's Revenge (joker.png), Apr. 1, 2021.
Bally Wulff: Hamster's Paradise (png), Mar. 7, 2019.
Bally Wulff: "Bally Wulff Games & Entertainment: Fun reloaded", Mar. 28, 2019.
Bally Wulff: "Fun reloaded: Bally Wulff launches with next generation of game packages", Mar. 7, 2019.

* cited by examiner

A payment of $100 has been recorded. The player has indicated a wager of $1.00 . Step credit values (C1 to C5) have been generated based on the wager.

The player earns a total of 3 steps on ladder 109A!
The step credit balance 116 has been updated to $3.30.

Now, the player can COLLECT credit values to the credit meter 112
OR
Wager the step credit value 116 on the subsequent play.

The player has chosen NOT to COLLECT any step credit value.

The player pressed PLAY!

The reels are spinning 3 x occurred on payline 2, which earns 2 steps on ladder 109C!

2 x occurred on payline 5, which earns 1 step on ladder 109B!

3 x occurred on payline 1 which earns 2 steps on ladder 109B!

Progress of 3 steps are updated on ladder 109B!

Progress of 2 steps are updated on ladder 109C!

The step credit balance 116 has been updated to $13.70.

The player can COLLECT credit values to the credit meter 112
OR
Wager the step credit value 116 on the subsequent play.

The player COLLECTS step S2 from ladder 109C and steps S1, S2, S3 from ladder 109A!

The collected step credit value of $4.90 has been added to the credit balance 112.

The step credit balance 116 has been updated to $8.80.

The player transfers credit to steps S4 and S5 of ladder 109B from the credit balance
The player transfers credit to steps S1 to S5 of ladder 109A from the credit balance.
The credit balance 112 remaining is $64.60
The total step credit value is $48.70

Also, since ladders 109A and 109B are full, the player can potentially win instant wins on the next game!

The player pressed PLAY!

The reels are spinning 2 x occurred on payline 3, which earns 1 step on ladder 109A!

But ladder 109A is full! So the player earns an instant win of $1.00

The player wants to transfer credit value to step S4 of ladder 109B!

The player needs $9 in his credit balance!

Sorry! The player has insufficient credit!

A terminator symbol T occurred!

The step credit value balance is now $0.00!

Since the step credit value balance $0.00, player is allowed to change the wager 114!

GAMING DEVICES AND METHODS FOR OPERATING A GAMING DEVICE

BACKGROUND

Field of the Invention

Various examples described herein relate to games of chance and in particular to gaming devices and methods for operating a gaming device.

Description of the Related Technology

Gaming devices, machines or consoles, such as slot machines, are popular within the gaming environment, and are one of the basic elements of the gaming industry. In order to encourage interest from players, game developers continue to invent new and innovative ways of representing games, game play, and awards.

SUMMARY

Various examples relate to gaming devices on which a game may be played, wherein the game integrates player's risk appetite into the progression of game play.

Various examples relate to a gaming device. The gaming device comprises a control arrangement. The control arrangement comprises interface control circuitry for communication with a user input interface; credit meter control circuitry for controlling a credit meter; and at least one processor and a memory arrangement for storing a plurality of instructions, which when executed by the at least one processor, causes the control arrangement to: cause play of a game comprising a display of a plurality of symbols at a plurality of symbol display positions of a plurality of reels, and display of a plurality of progression structures, wherein a progression structure comprises a plurality of steps, wherein each step is associated with a step credit value; cause game-based progression along the steps of the plurality of progression structures based on the occurrence of symbol combinations of the plurality of symbols at at least one of the plurality of symbol display positions; receive, via the interface control circuitry, credit value transfer information for causing a user-initiated update of a progression structure of the plurality of progression structures, wherein the credit value transfer information comprises progression structure identity information identifying a selected progression structure, and step selection information identifying one or more selected steps of the selected progression structure to be updated; and cause the user-initiated update of the selected progression structure and the credit meter based on the credit value transfer information.

Various examples relate to a method for operating a gaming device. The method comprises: causing play of a game comprising a display of a plurality of symbols at a plurality of symbol display positions of a plurality of reels, and display of a plurality of progression structures, wherein a progression structure comprises a plurality of steps, wherein each step is associated with a step credit value; causing game-based progression along the steps of the plurality of progression structures based on the occurrence of symbol combinations of the plurality of symbols at at least one of the plurality of symbol display positions; receiving, via interface control circuitry, credit value transfer information for causing a user-initiated update of a progression structure of the plurality of progression structures, wherein the credit value transfer information comprises progression structure identity information identifying a selected progression structure, and step selection information identifying one or more selected steps of the selected progression structure to be updated; and causing the user-initiated update of the selected progression structure and the credit meter based on the credit value transfer information.

Various examples further relate to a computer-readable storage medium storing a plurality of instructions, which when executed by a processor, causes the processor to perform the said method described in accordance with the various examples.

BRIEF DESCRIPTION OF THE DRAWINGS

Some examples of apparatuses and/or methods will be described in the following by way of example only, and with reference to the accompanying figures, in which.

DETAILED DESCRIPTION

Figure 1A:
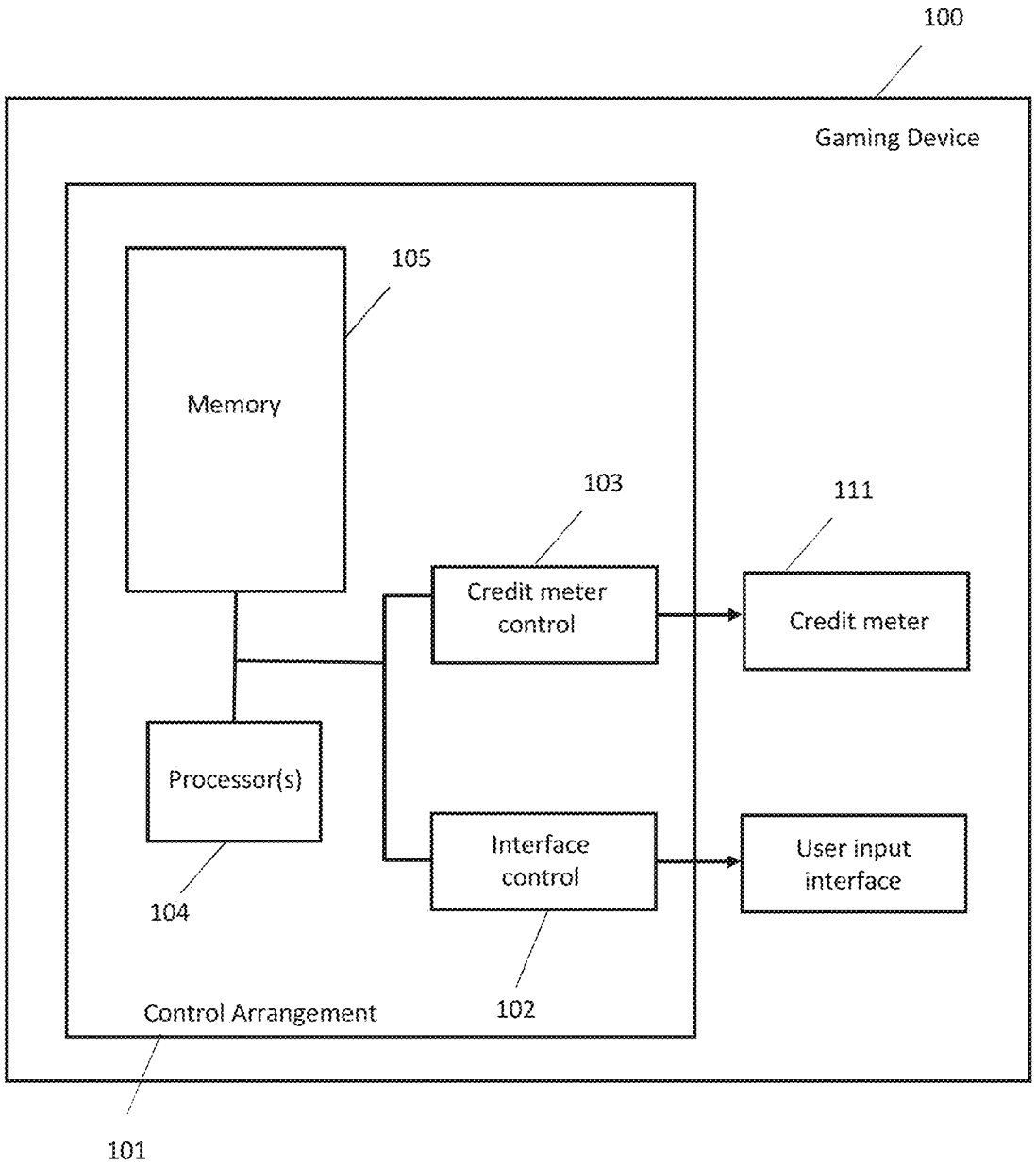
FIG. 1A shows a schematic illustration of a gaming device according to various embodiments.

The detailed description of various embodiments makes reference to the accompanying drawings, which show the exemplary embodiments by way of illustration. Thus, the detailed description herein is presented for purposes of illustration only and not of limitation. Throughout the description of the figures same or similar reference numerals refer to same or similar elements and/or features, which may be identical or implemented in a modified form while providing the same or a similar function. The thickness of lines, layers and/or areas in the figures may also be exaggerated for clarification.

It will be understood that when an element is referred to as being "connected" or "coupled" to another element, the elements may be directly connected or coupled or via one or more intervening elements. If two elements A and B are combined using an 'or', this is to be understood as disclosing all possible combinations, i.e. only A, only B as well as A and B, unless expressly defined otherwise in the individual case. As an alternative wording for the same combinations, "at least one of A and B" or "A and/or B" may be used. This applies equivalently to combinations of more than two elements. If a singular form, such as "a", "an" and "the" is used and the use of only a single element is not defined as mandatory either explicitly or implicitly, further examples may also use several elements to implement the same function. If a function is described below as implemented using multiple elements, further examples may implement the same function using a single element or a single processing entity. If the terms "include", "including", "comprise" and/or "comprising" are used, they describe the presence of the specified features, integers, steps, operations, processes, elements, components and/or a group thereof, but do not exclude the presence or addition of one or more other features, integers, steps, operations, processes, elements, components and/or a group thereof. Several (or different) elements discussed below, and/or claimed, are described as being "coupled", "in communication with", or "configured to be in communication with". This terminology is intended to be non-limiting, and where appropriate, be interpreted to include without limitation, wired and wireless communication using any one or a plurality of a suitable protocols or communication methods.

Figure 1B:
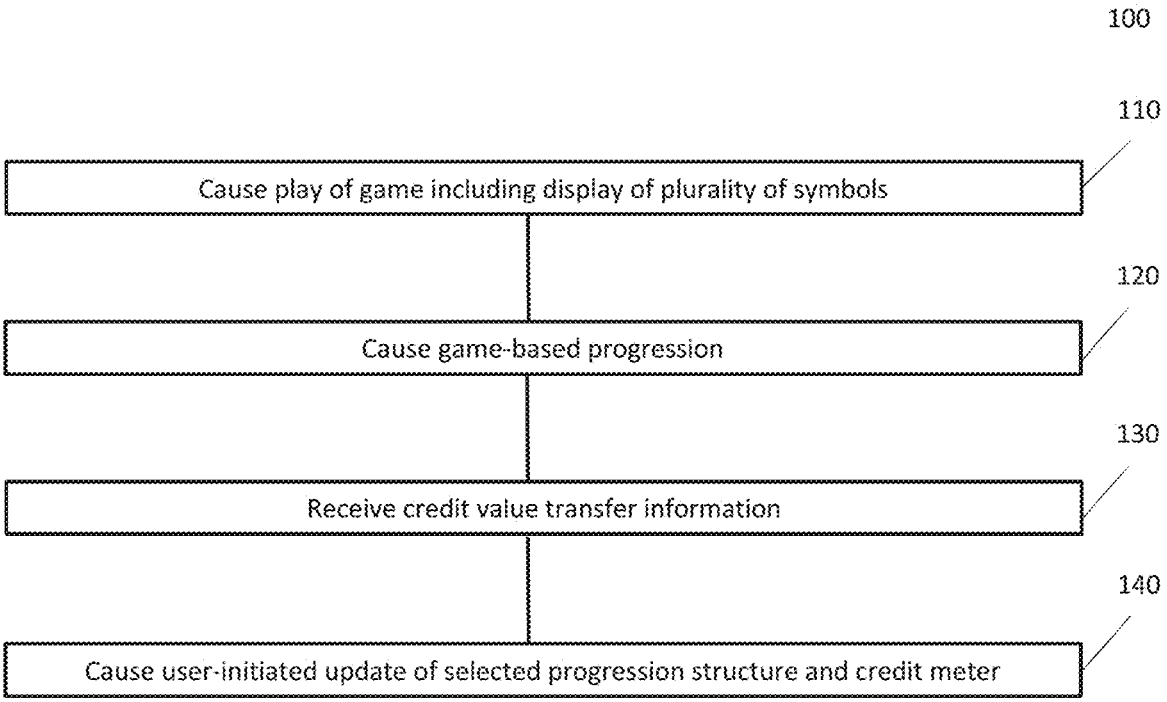
FIG. 1B shows a flow chart of a method for operating a gaming device according to various embodiments.

FIG. 1A shows a schematic illustration of a gaming device 100 according to various embodiments. The gaming device 100 includes a control arrangement 101. The control arrangement 101 includes interface control circuitry 102 for communication with a user input interface. The control arrangement 101 further includes credit meter control circuitry 103 for controlling a credit meter. The control arrangement 101 further includes at least one processor 104 and a memory arrangement 105 for storing a plurality of instructions, which when executed by the at least one processor 104, causes the control arrangement 101 to cause play of a game (FIG. 1B, 110).

Figure 1D:
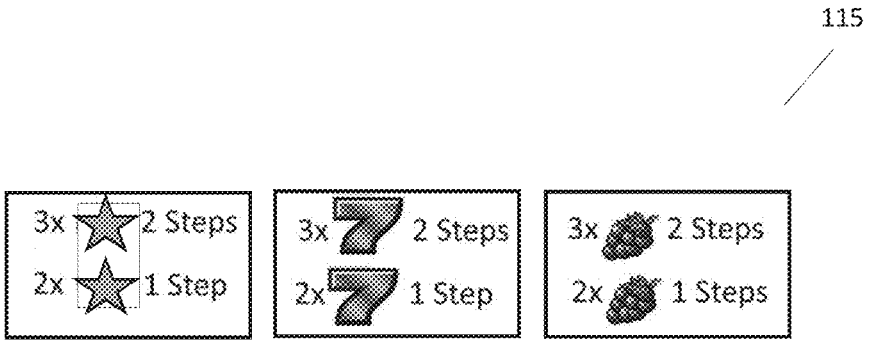
FIG. 1D shows a schematic illustration of a pay table for play of the game according to various embodiments.
Figure 1C:
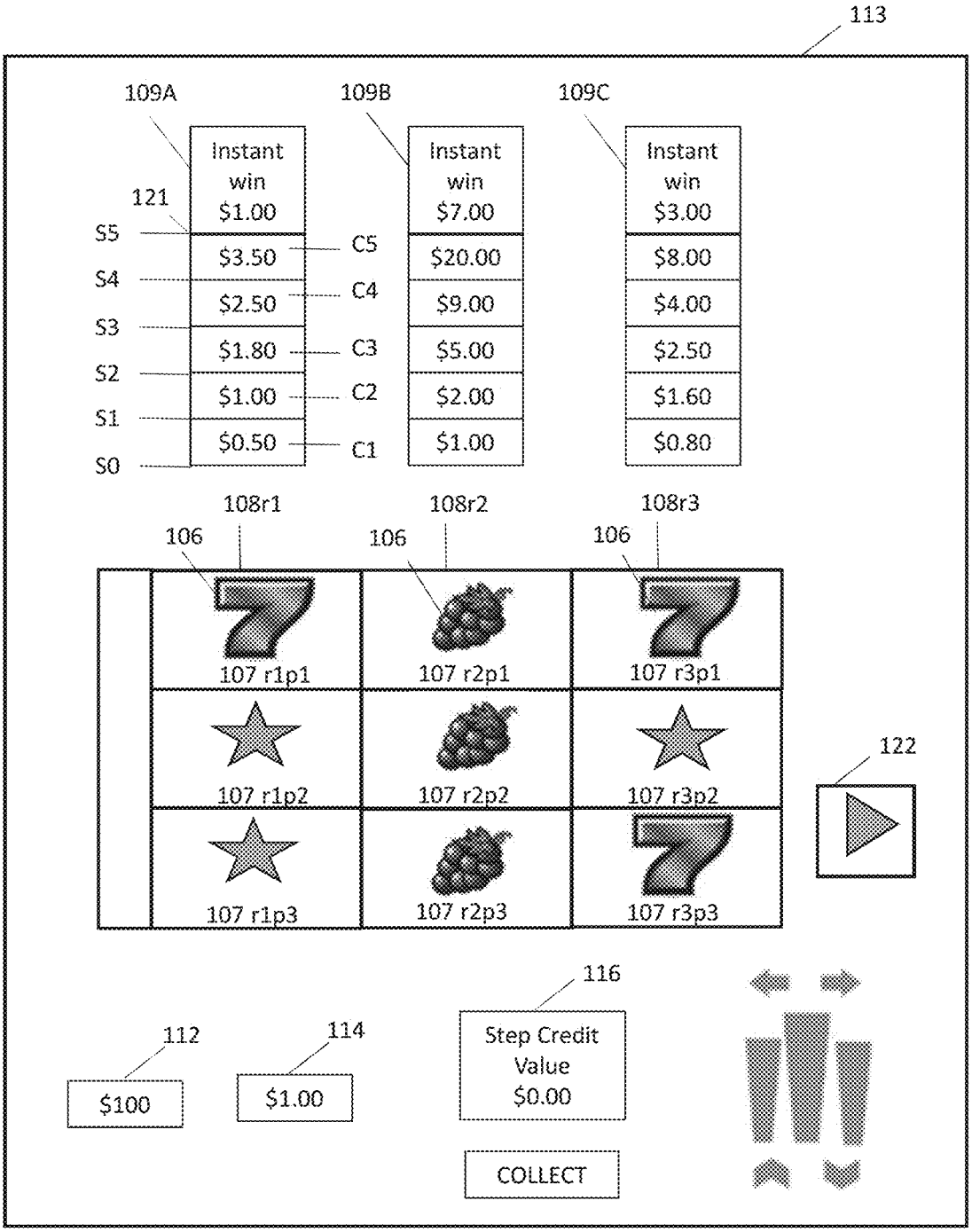
FIG. 1C shows a schematic illustration of display of the play of the game by a display device according to various embodiments.

The play of the game includes a display of a plurality of symbols 106 at a plurality of symbol display positions 107 of a plurality of reels 108 (FIG. 1C). The play of the game includes display of a plurality of progression structures 109A, 109B, 109C. A (or each) progression structure 109A, 109B, 109C includes a plurality of steps 121. Each step (e.g. S1 to S5) is associated with a step credit value (e.g. C1 to C5). The control arrangement 101 causes game-based progression (FIG. 1B, 120) along the steps 121 of the plurality of progression structures 109A, 109B, 109C based on the occurrence of symbol combinations of the plurality of symbols 106 at at least one of the plurality of symbol display positions 107.

The control arrangement 101 receives, via the interface control circuitry 102, credit value transfer information (FIG. 1B, 130) for causing a user-initiated update of a progression structure of the plurality of progression structures 109A, 109B, 109C. The credit value transfer information includes progression structure identity information identifying a selected progression structure 109A, 109B, 109C. The credit value transfer information further includes step selection information identifying one or more selected steps (e.g. any one or more of steps S1 to S5) of the selected progression structure to be updated.

The control arrangement 101 causes the user-initiated update (FIG. 1B, 140) of the selected progression structure 109A, 109B, 109C and the credit balance 112 of the credit meter 111 based on the credit value transfer information.

FIG. 1C shows an illustration of the display of the play of the game on a display device 113 according to various embodiments. The game to be played may be a game of chance. In order for a play of a game to take place, the gaming device may accept payment from a player (or user). The credit meter control circuitry 103 may include (be part of, or may be) a credit meter 111. The credit meter control circuitry 103 may determine the amount of funds received, which may control or update the credit meter 111 so that a credit balance 112 of the credit meter 111 is displayed on the display 113. As shown in the example of FIG. 1C, a credit payment of $100.00 has been accepted by the gaming device 100. In addition, the player may be invited to enter a wager (or bet) for the play of a game. The control arrangement 103 may be caused or configured to receive the initial wager (or bet) for the play of a game. As shown in the example of FIG. 1C, an initial wager of $1.00 has been entered by the player.

A progression structure may be a ladder or any other structure with a starting level (level zero), an end level (level maximum) with any predefined number of intermediate levels between the starting level and the end level.

The control arrangement 103 may be configured to assign step credit values (C1 to C5) to the steps 121 of the plurality of progression structures 109A, 109B, 109C based on the initial wager. For example, the control arrangement 103 may include step credit value allocation circuitry for assigning step credit values to the steps 121 of the plurality of progression structures based on a received wager. Optionally, the step credit value allocation circuitry may be configured to calculate the step credit values of each step of the (each) respective progression structure 109A, 109B, 109C. Alternatively or additionally, the step credit values may be pre-determined values. The step credit value allocation circuitry may be configured to obtain or retrieve step credit values (e.g. from a memory) based on the received wager (or bet amount). Each respective wager may be associated with a respective set of step credit values, wherein each set of step credit values includes respective step credit values for each respective step of the plurality of progression structures 109A, 109B, 109C. The step credit value allocation circuitry may be configured to transmit information comprising the step credit values to display control circuitry which causes the display device 113 to display the step credit values (C1 to C5) corresponding to the steps (S1 to S5) of the plurality of progression structures 109A, 109B, 109C. In addition, the display control circuitry may cause the display device 113 to display the wager 114.

It may be understood that the display shown in FIG. 1C is to be used as an example, and should not be interpreted as being limiting. For example, although three progression structures 109A, 109B, 109C are shown in FIG. 1C, the number of progression structures is not limited to three, but may be any number (or integer) greater than 1. In addition, each progression structure in FIG. 1C is shown to have the same number of steps. However, alternatively or optionally, each progression structure may have a different total number of steps from each other. In addition, FIG. 1C shows three reels (labelled 108*r*1, 108*r*2, 108*r*3). However, the number of reels is not limited to any fixed number and may include any suitable number of reels. In addition, FIG. 1C shows that each reel may include three display positions (p1, p2, p3). However, the number of display positions is not limited to any fixed number and each reel may include any suitable number of display positions.

FIG. 1D shows a schematic illustration of a pay table 115 showing rules for progression along the steps of the plurality of progression structures 109. As shown in the pay table 115 of FIG. 1D, the occurrence of three "star" symbols on a pay line may cause a forward progression of two steps along the first progression structure 109A. The occurrence of two "star" symbols on a pay line may cause a forward progression of one step along the first progression structure 109A. The occurrence of three "seven" symbols on a pay line may cause a forward progression of two steps along the second progression structure 109B. The occurrence of two "seven" symbols on a pay line may cause a forward progression of one-step along the second progression structure 109B. The occurrence of three "grapes" symbols on a pay line may cause a forward progression of two steps along the third progression structure 109C. The occurrence of two "grapes" symbols on a pay line may cause a forward progression of one step along the third progression structure 109C.

During the play of the game, progression along the progression structure between the starting level and the end level may be earned in various ways. One way of progressing with respect to a progression structure may be game-based progression, wherein a randomly generated symbol outcome on the plurality of reels determines a progression along one or more progression structures. The control arrangement 101 may include progression determination circuitry for determining a progression status of respective progression structures of the plurality of progression structures. The progression status may be determined or calculated based on the rules of the pay table 115 and the symbol combinations randomly generated at the plurality of symbol display positions 107. It may be understood that in the figures, each symbol display position 107 may be labelled according to the following labelling convention, which defines a reel (r1=reel 1, r2=reel 2, r3=reel 3) and a position on the reel (p1=row 1, p2=row 2, p2=row 3). For example, the display position 107*r*1*p*1 refers to a display position position 107 on reel 1 (r1) and row 1 (p1).

Figure 2A:
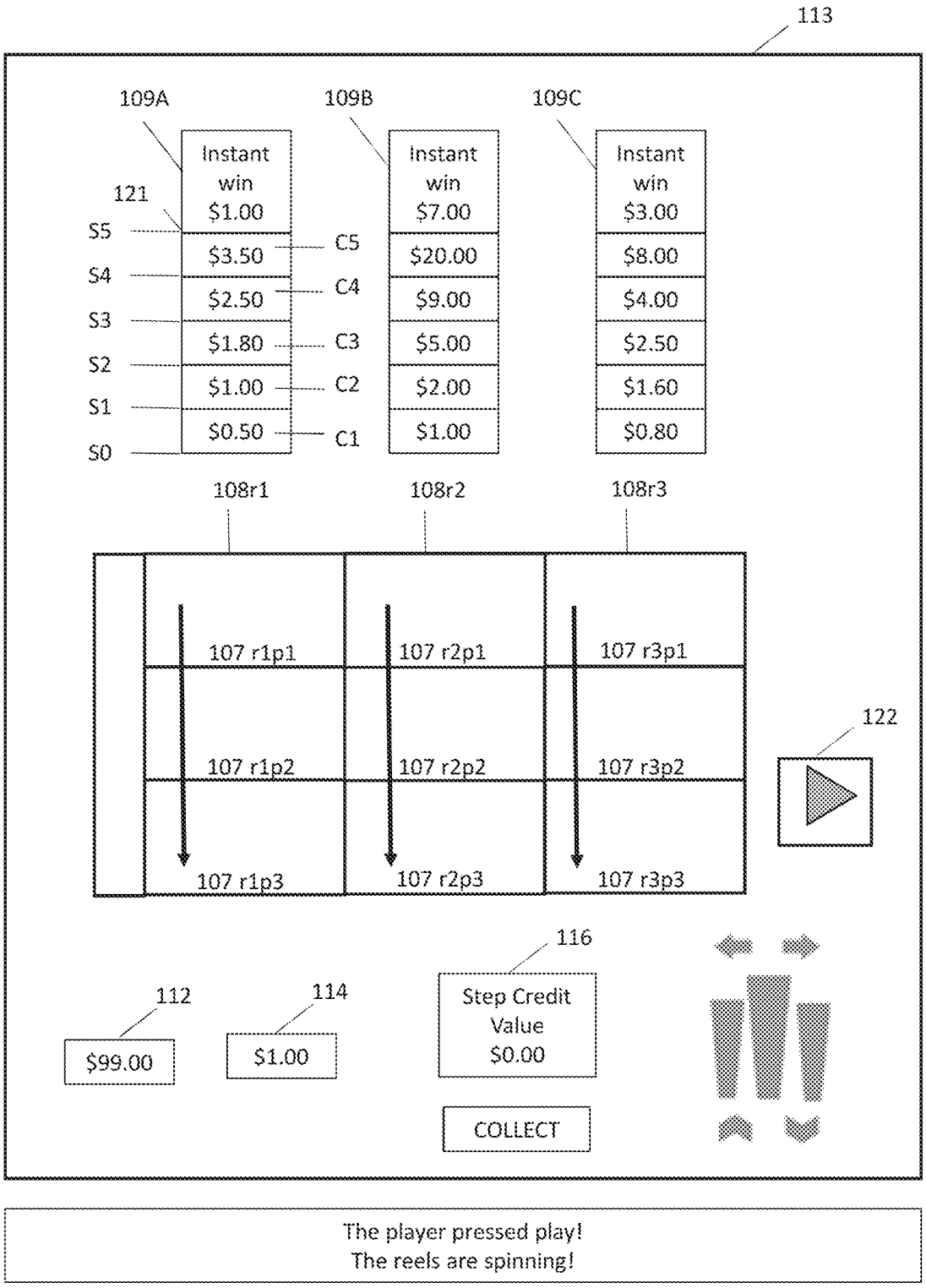
FIGS. 2A to 2C show schematic illustrations of examples of play of a game executed by a gaming device according to various embodiments.
Figure 2B:
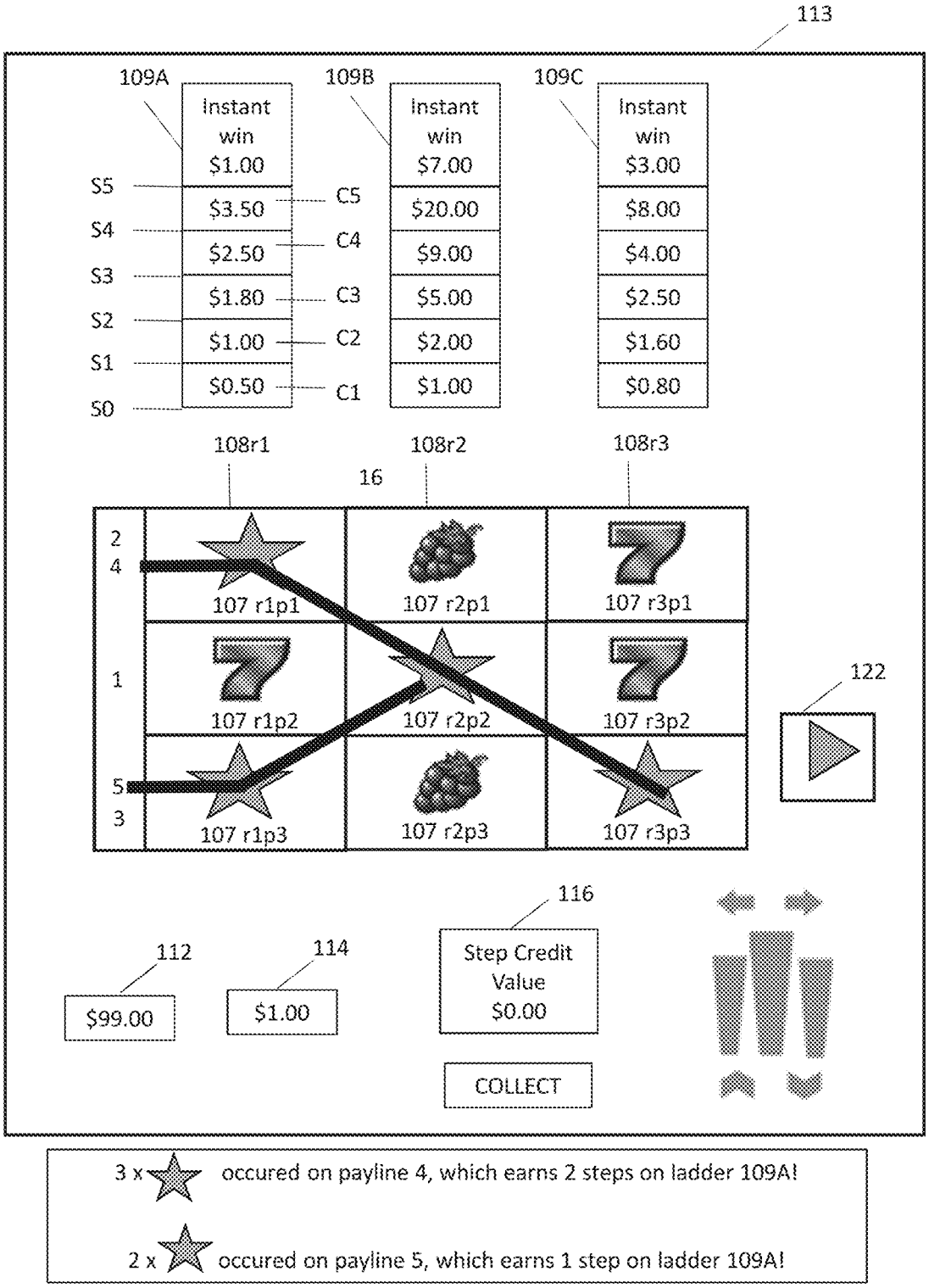
Figure 2C:
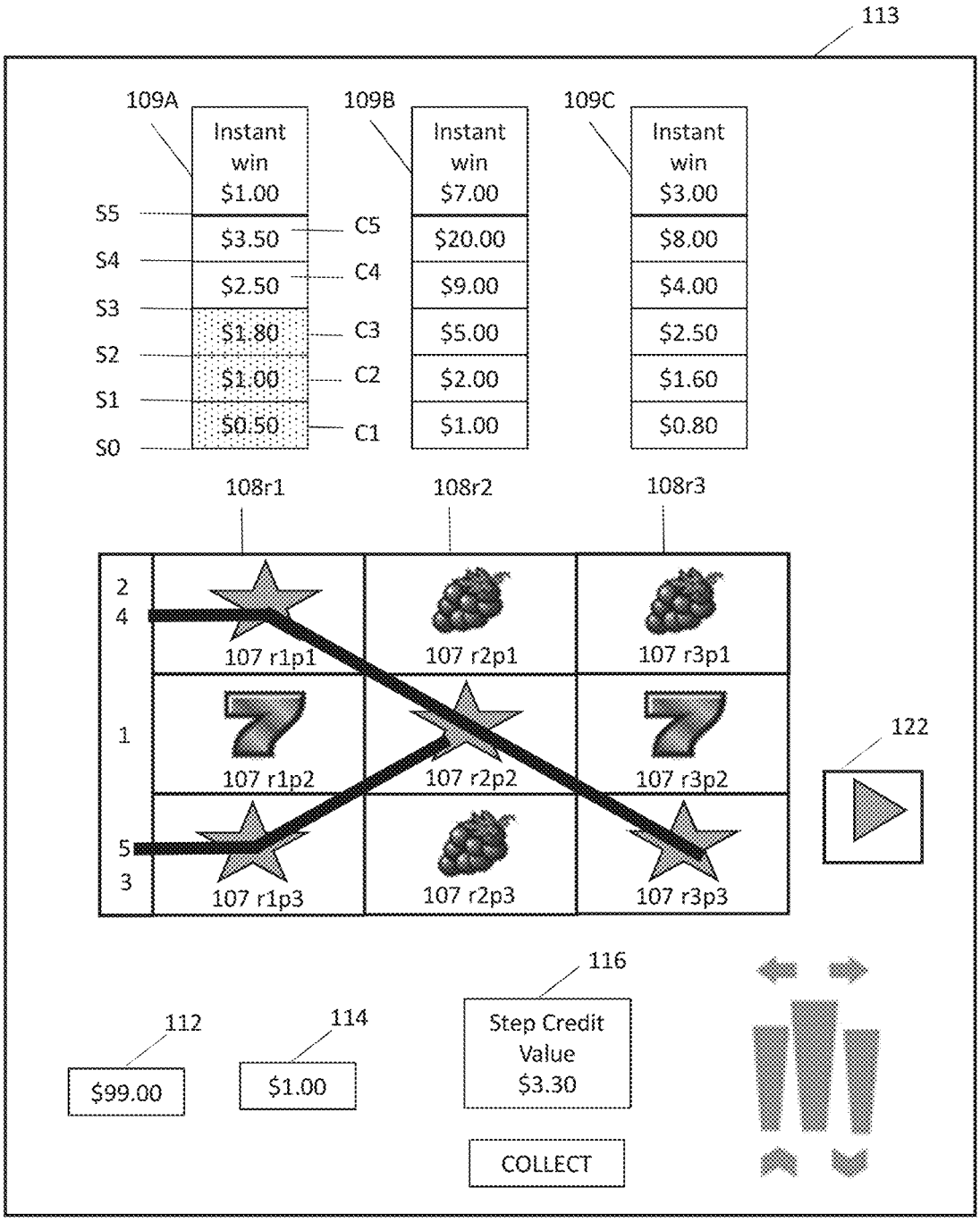

FIGS. 2A to 2C show schematic illustrations of examples of play of a game executed by the gaming device 100 already described in connection with FIGS. 1A to 1D.

As shown in FIG. 2A, after the initial wager has been received, and after assigning the step credit values to the steps of the plurality of progression structures, the control arrangement 103 may cause random generation of the plurality of symbols 106 at the plurality of symbol display positions 107. In response to receiving a trigger to play the game (e.g. by sensing the push of a play button 122), the control arrangement 103 may cause display of one or more randomly generated symbol combinations of the plurality of symbols 106 at the plurality of symbol display positions 107.

In response to sensing the trigger to play the game, the control arrangement 101 may cause the reels to spin.

As shown in the example of FIG. 2B, symbol combinations of three "star" symbols have been randomly generated along a pay line 4, and two"star" symbols have been randomly generated along a pay line 5 in the current play of the game. Based on the rules of the pay table 115 and the occurrence of symbol combinations, the control arrangement 101 (e.g. the progression determination circuitry) may determine that a game-based progression of 2+1=3 steps along the first progression structure 109A is to be updated. Based on the current progression status (e.g. Step 0) of the first progression structure 109A, the control arrangement 101 may identify the steps (e.g. S1, S2, S3) of the first progression structure 109A to be updated with respect to the current progression status.

As shown in FIG. 2C, the control arrangement 101 then causes game-based progression along the identified steps (e.g. S1, S2, S3) of the one or more progression structures based on the randomly generated symbol combinations displayed at the plurality of symbol display positions 107. The control arrangement 101 (e.g. the progression determination circuitry) may be configured to update the progression status of the progression structure 109A by the determined number of steps. For example, the current progression status of the progression structure 109A may be updated from S0 to S3. Updating the progression status of the progression structure 109A may further include the control arrangement 101 being configured to transmit information to the display control circuitry to cause the steps (e.g. S1, S2 and S3) to be highlighted on the display device 113 so that the player may be informed of the update of the progression status.

The progression determination circuitry of the control arrangement 101 may further be coupled to step credit control circuitry of the control arrangement 101. The step credit control circuitry may be configured to determine the step credit balance 116 based on the progression status of the plurality of progression structures. The step credit control circuitry may calculate (e.g. by summing or adding) the step credit balance associated with the determined steps. In the case of the example of FIG. 2B, the step credit control circuitry may sum up (e.g. add together) the step credit values C1, C2 and C3 ($0.50+$1.00+$1.80=$3.30) of the determined steps and cause an update of the step credit balance 116 ($3.30). Based on the symbol combinations that occur, the progression determination circuitry may determine the progression status for each progression structure of the plurality of progression structures 109A, 109B, 109C. Furthermore, the step credit control circuitry may determine the step credit balance based on the progression status of each progression structure of the plurality of progression structures 109A, 109B, 109C.

After the occurrence of the symbol combination for that current play of the game, the player can optionally collect the step credit values (C1, C2, C3) associated with the the earned progression steps to the credit meter 111 according to a sequential backward progression (or regression). In other words, any of the step credit values C3, C2, C1, may be collected in backward sequential order. Alternatively, the player can choose not to collect credit values to the credit meter 111. The credit values that are not collected to the credit meter 111 may remain in the step credit balance 116 as a wager on the subsequent play. Any collected step credit values may be added to the credit meter balance 112 and deducted from the step credit value 116. Any remaining (uncollected) step credit value may remain in the step credit balance 116, and may be wagered on the subsequent play of the game. The volatility of the subsequent game may be based on remaining step credit values corresponding to the determined progression status of the respective progression structures.

The user-initiated update of the progression structure may be carried out during an update time period using a user input device (shown as 129 in FIGS. 3D to 4A). The update time period may be between a current play of the game and a subsequent play of the game, such as between a time when the reels finish spinning in response to a first play of the game, and before the reels starting spinning in response to a second play of the game. For example, the control arrangement 101 may be configured to receive, via the interface control circuitry 102, the credit value transfer information before a subsequent game of play. Optionally, additionally or alternatively, the control arrangement 101 may be configured to receive the credit value transfer information between a current play of the game and a subsequent play of the game. Optionally, additionally or alternatively, the control arrangement 101 may be configured to receive the credit value transfer information after the game-based progression and the update of the step credit balance has been updated based on the outcome of the current play of the game, and before a subsequent play of the game.

The player may input his selection via a user input interface or device. The player's input may be detected by the interface control circuitry which receives the credit value transfer information.

FIGS. 3A to 3D show schematic illustrations of examples of play of a game executed by the gaming device 100 already described in connection with FIGS. 1A to 2C.

Figure 3A:
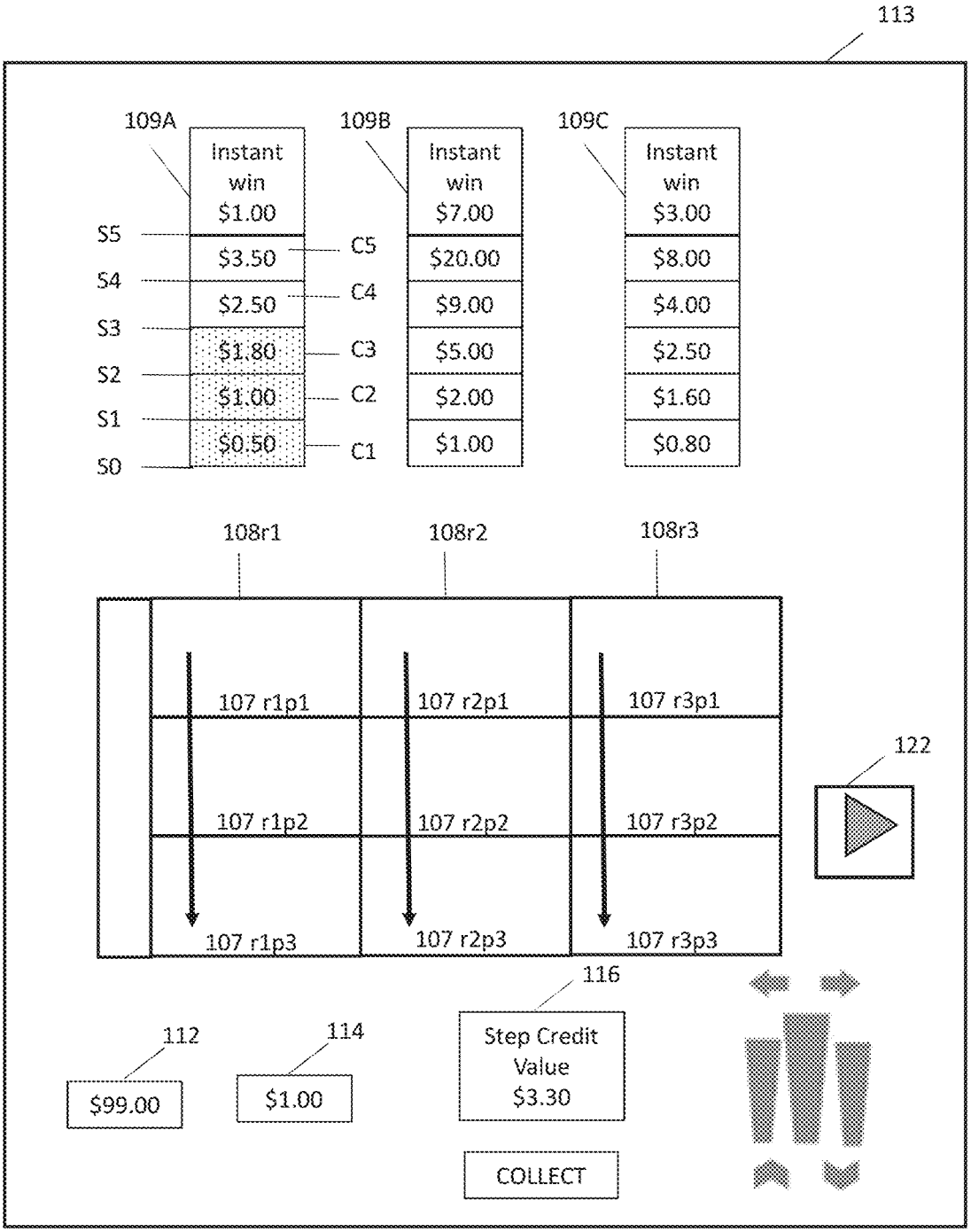
FIGS. 3A to 3D show schematic illustrations of further examples of play of a game executed by the gaming device according to various embodiments.
Figure 3B:
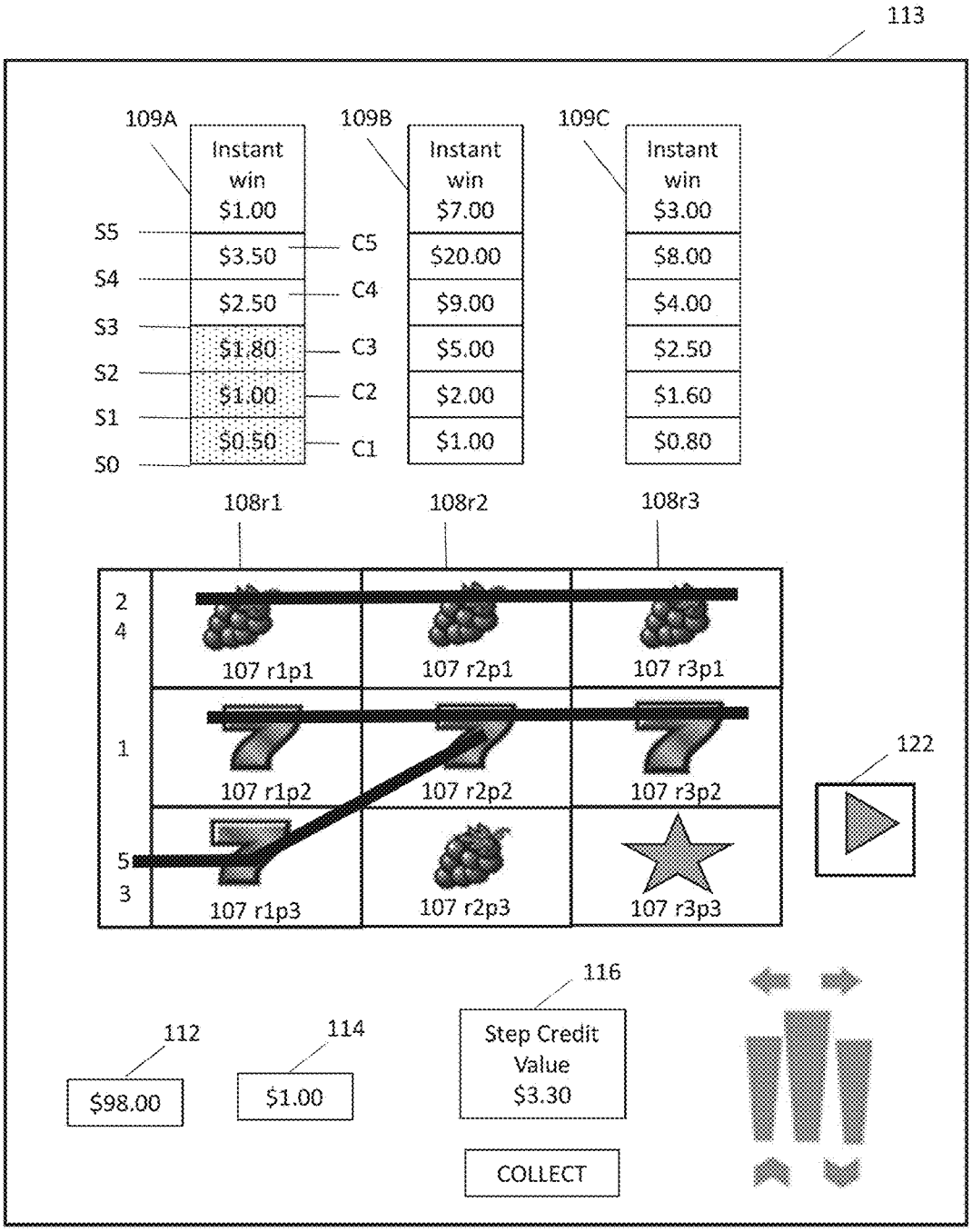

As shown in FIG. 3A, the player may choose not to collect any step credit value. The player triggers the subsequent play of a game (e.g. by pressing play). As shown in FIG. 3B, the control arrangement 103 may cause display of one or more randomly generated symbol combinations of the plurality of symbols 106 at the plurality of symbol display positions 107. Three "grapes" symbols were randomly generated along pay line 2. Two "seven" symbols were randomly generated along pay line 5. Three "seven" symbols were randomly generated along pay line 1. Based on the rules of the pay table 115, the control arrangement 101 (e.g. the progression determination circuitry) may determine that a game-based progression of twosteps along the third progression structure 109C is to be updated. Based on the current progression status (e.g. Step 0) of the third progression structure 109C, the control arrangement 101 may identify the steps (e.g. S1, S2) of the progression structure 109C to be updated with respect to the current progression status. Furthermore, based on the rules of the pay table 115, the control arrangement 101 (e.g. the progression determination circuitry) may determine that a game-based progression of 2+1=3 steps along the second progression structure 109B is to be updated. Based on the current progression status (e.g. Step 0) of the second progression structure 109B, the control arrangement 101 may identify the steps (e.g. S1, S2, S3) of the second progression structure 109B to be updated with respect to the current progression status.

Figure 3C:
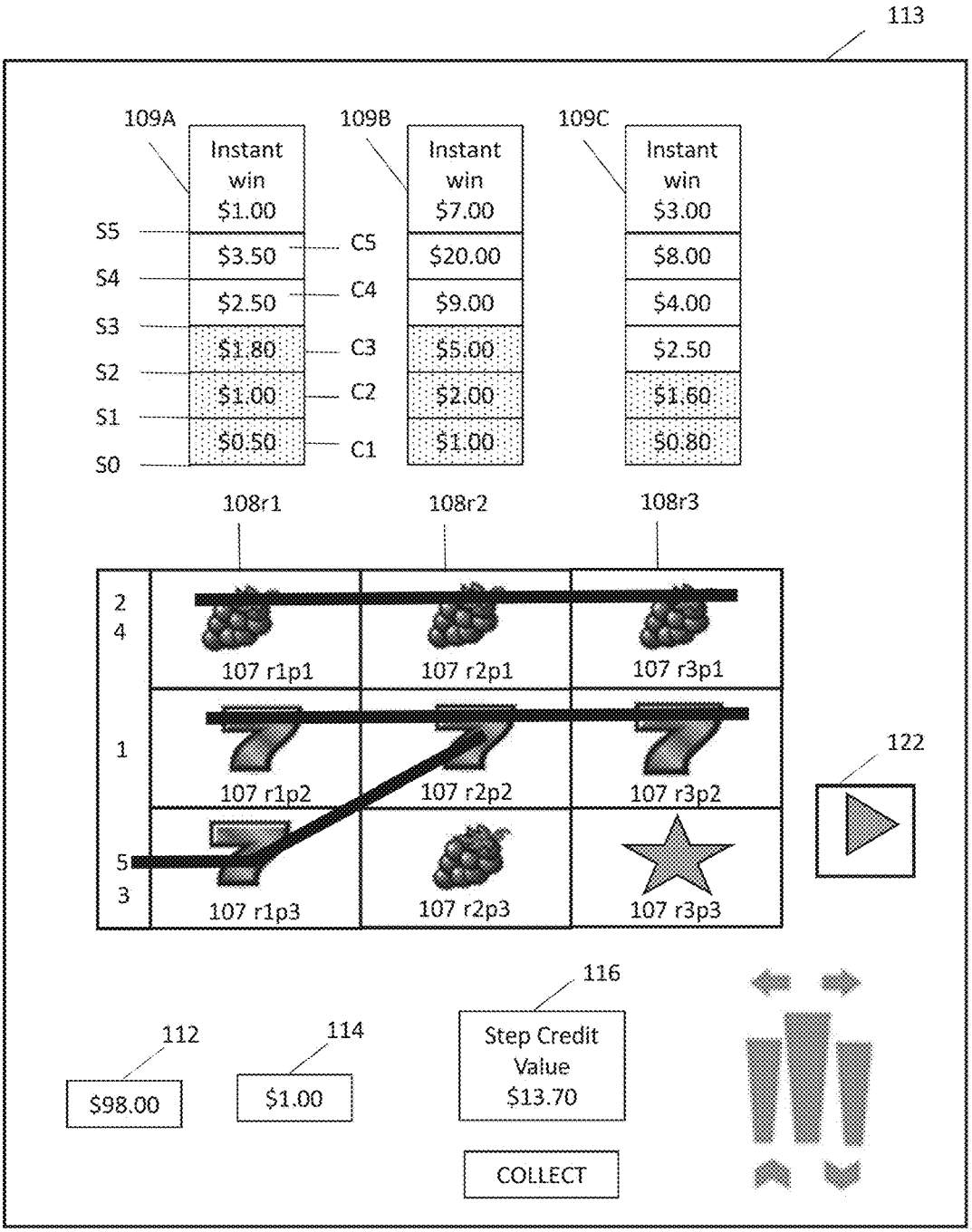

As shown in FIG. 3C, the control arrangement 101 then causes game-based progression along the identified steps (e.g. S1, S2, S3) of the second progression structure 109B and along identified steps (e.g. S1, S2) of the third progression structure 109C. The step credit control circuitry may update the step credit balance 116 based on a summation of the step credit values of the determined steps. In the case of the example of FIG. 2B, the step credit control circuitry may sum up (e.g. add) the step credit values ($1.00+$2.00+$5.00+$0.80+$1.60=$10.40) determined in the play of the game to the step credit values ($3.30). The step credit control circuitry may therefore update the step credit balance 116 to $10.40+$3.30=$13.70.

The player can choose to optionally collect one or more credit values (C1, C2, C3) associated with the the earned progression steps of each of the progression structures to the credit balance 112 in backward sequential order. Alternatively, the player can choose not to collect credit values to the credit balance 112.

Figure 3D:
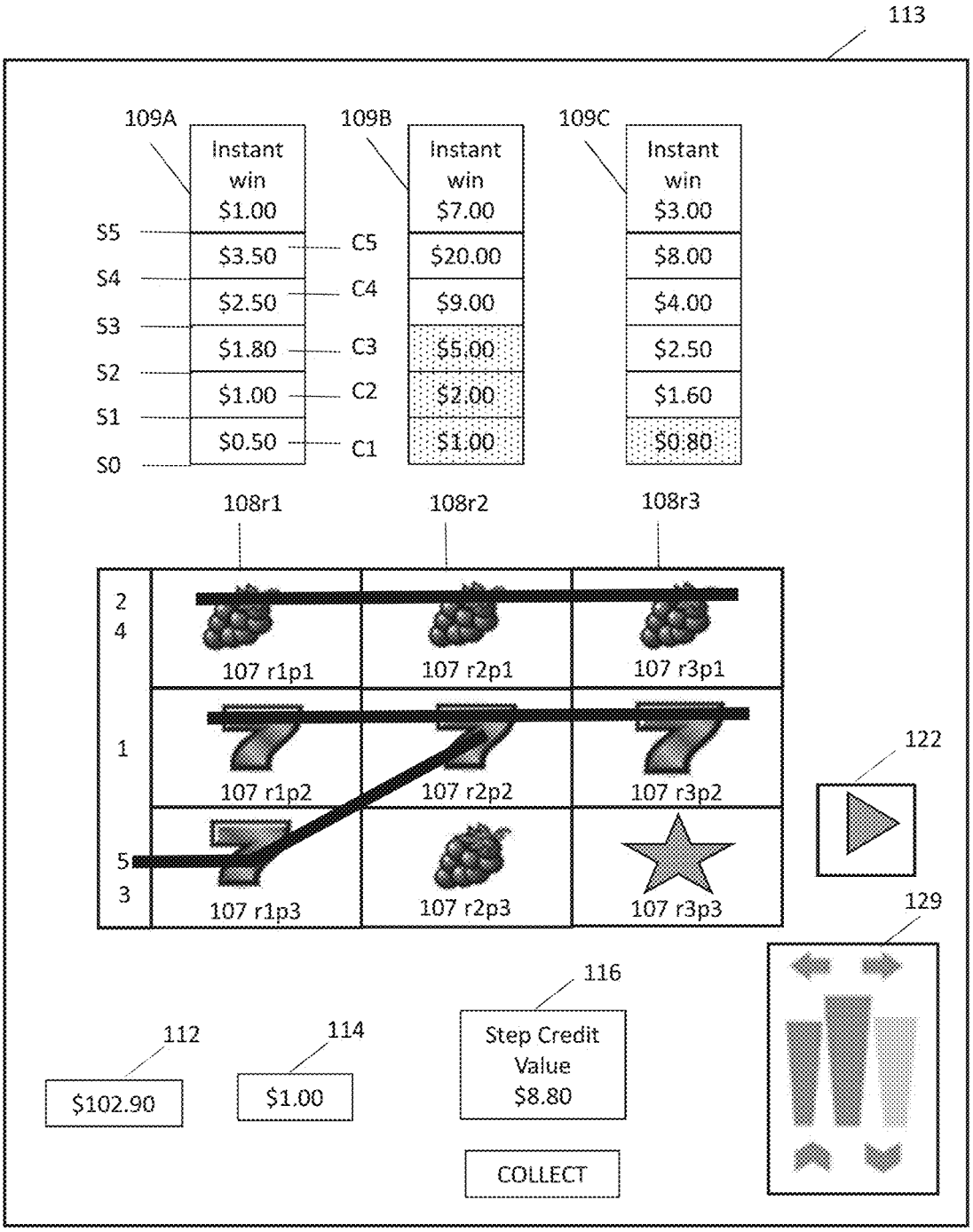

As shown in FIG. 3D, the player may choose to collect 1 step (e.g. step S2) from the third progression structure 109C and all the steps (e.g. 3 steps, S1, S2, S3) from the first progression structure 109A. In order to input his selection, the player may select the progression structure 109C and the number of steps (in backwards sequence) which are to be collected. The player may repeat this for each progression structure that he wishes to collect from. The control arrangement 101 receives, via the interface control circuitry 102, credit value transfer information for causing the user-initiated update of a progression structure of the plurality of progression structures 109A, 109B, 109C. The credit value transfer information includes progression structure identity information identifying a (e.g. one or more) selected progression structure 109A, 109B, 109C to be updated, and step selection information identifying one or more selected steps of the (e.g. each respective) selected progression structure to be updated.

The control arrangement 101 may be configured update the progression status of at least one respective progression structure based on the user-initiated update. The player may be free to select any progress progression structure independently of other progression structures of the plurality of progression structures. The player may also be free to select the steps (e.g. the number of selected steps), independently of other progression structures. For example, the step selection information may include a quantity of steps of the selected progression structure to be updated. The control arrangement 101 may be configured to cause the user-initiated update of the selected progression structure independently of other progression structures of the plurality of progression structures 109.

For example, the control arrangement may be configured to cause a user-initiated update to the (e.g. each) respective selected progression structures based on the respective step selection information. The control arrangement 101 may be configured to cause the user-initiated update of the selected progression structure by the quantity of steps. The quantity of selected steps of a selected progression structure may range from one to the total number of steps of the selected progression structure. Optionally, the number of selected progression structures may be less than the total number of progression structures of the plurality of progression structures.

The user-initiated update by the control arrangement 101 may include an update of the credit meter 111 based on one or more step credit values of the one or more selected steps of the selected progression structure. For example, the step credit values ($1.60+$1.80+$1.00+$0.50=$4.90) associated with the selected steps of the selected progression structures may be added to the credit balance 112 and deducted from the step credit balance 116. For example, the credit balance 112 of the credit meter 111 may be updated to $102.90 and the step credit balance 116 may be updated to $8.80.

The control arrangement 101 may be configured to receive the credit value transfer information that causes the user-initiated update before a subsequent game of play. The examples shown in FIGS. 3A to 3D illustrate how the user-initiated update may cause a user-initiated backward progression of one or more steps along the steps of the selected progression structure. In addition, the user-initiated update may cause a user-initiated forward progression of one or more steps along the steps of the selected progression structure. A user-initiated backward progression may be associated with an addition of one or more step credit values corresponding to the one or more steps to the credit meter. A user-initiated forward progression may be associated with a deduction of one or more step credit values corresponding to the one or more steps from the credit meter.

The interface control circuitry 102 may be configured for communicating with the user input device or interface. The user input device 129 may include input means in the form of one or more buttons or selection symbols (e.g. left-right buttons, and e.g. up-down buttons) which the user may use for selecting a progression structure and a number of progression steps. Optionally, the one or more buttons may be physical buttons. For example, the user input device 129 may include input means for selecting a progression structure of the plurality of progression structures and input means for selecting a number of progression steps associated with the selected progression structure. Alternatively or optionally, the user input device may be part of a touch-screen display device. The player may input the selections by touching the display screen. The player inputs may be sensed and processed by the interface control circuitry 102. The user input device 129 may include a first group of input means (which may optionally be selection symbols e.g. 129A, 129B, 129C) for selecting a progression structure of the plurality of progression structures. For example, by pressing, touching and/or selecting a selection symbol (e.g. 129B) of the first group of selection symbols, the respective progression structure (e.g. 109B) associated with the selected selection symbol may be selected. The display control circuitry may be configured to highlight the selected progression structure. The highlight may include highlighting the selected progression structure 109B itself and/or highlighting the selected selection symbol 129B. The user input device 129 may include a second group of input means (or selection symbols, e.g. 129U, 129D) for selecting a number of progression steps associated with the selected progression structure. For example, pressing, touching and/or selecting a first selection symbol (e.g. 129U) of the second group of selection symbols may indicate or select the number progression steps in the increasing (upward or forward) direction. For example, pressing, touching and/or selecting a second selection symbol (e.g. 129D) of the second group of selection symbols may indicate or select the number progression steps in the decreasing (downward or backward) direction.

Figure 4A:
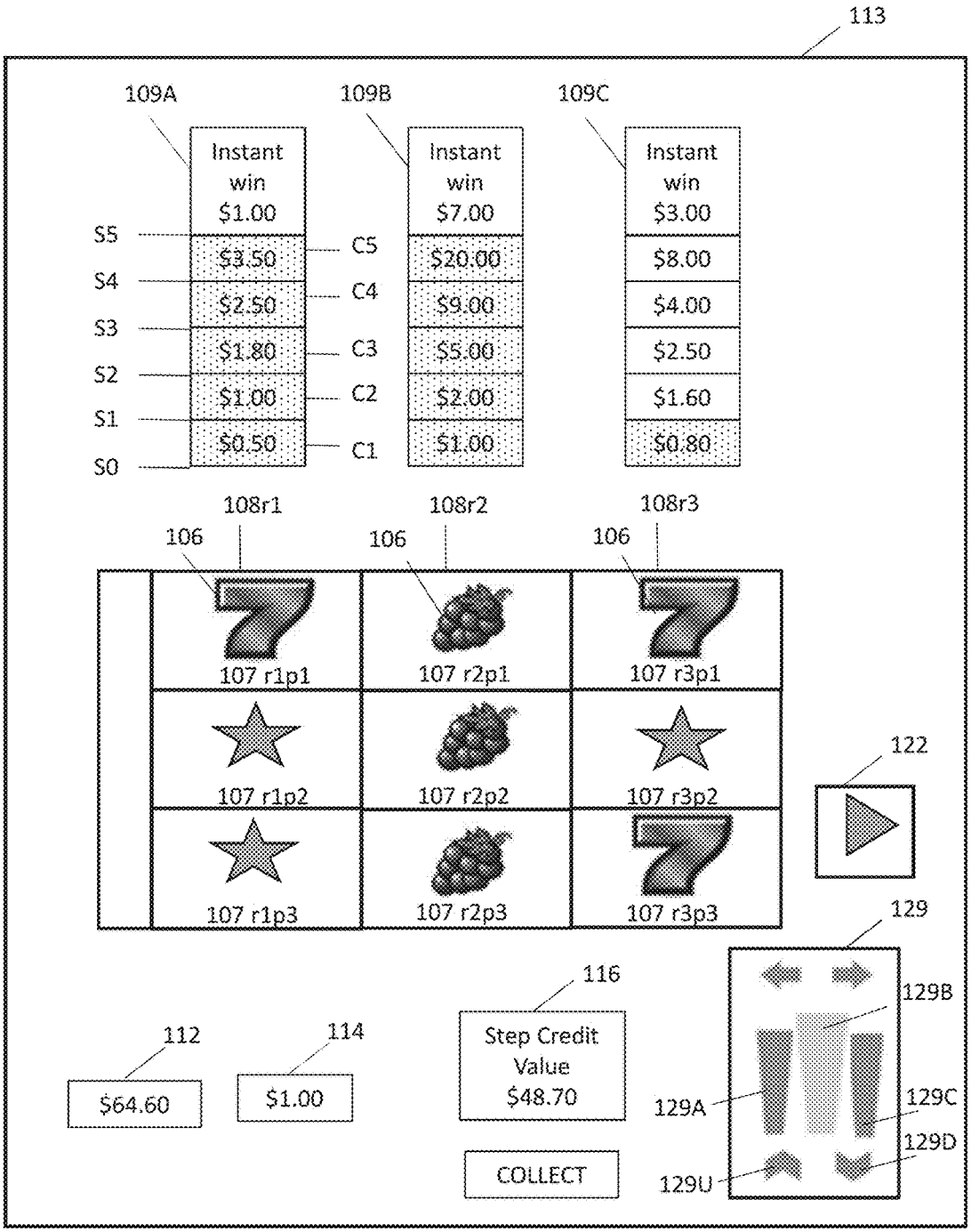
FIGS. 4A to 4C show schematic illustrations of further examples of play of a game executed by the gaming device according to various embodiments.
Figure 4B:
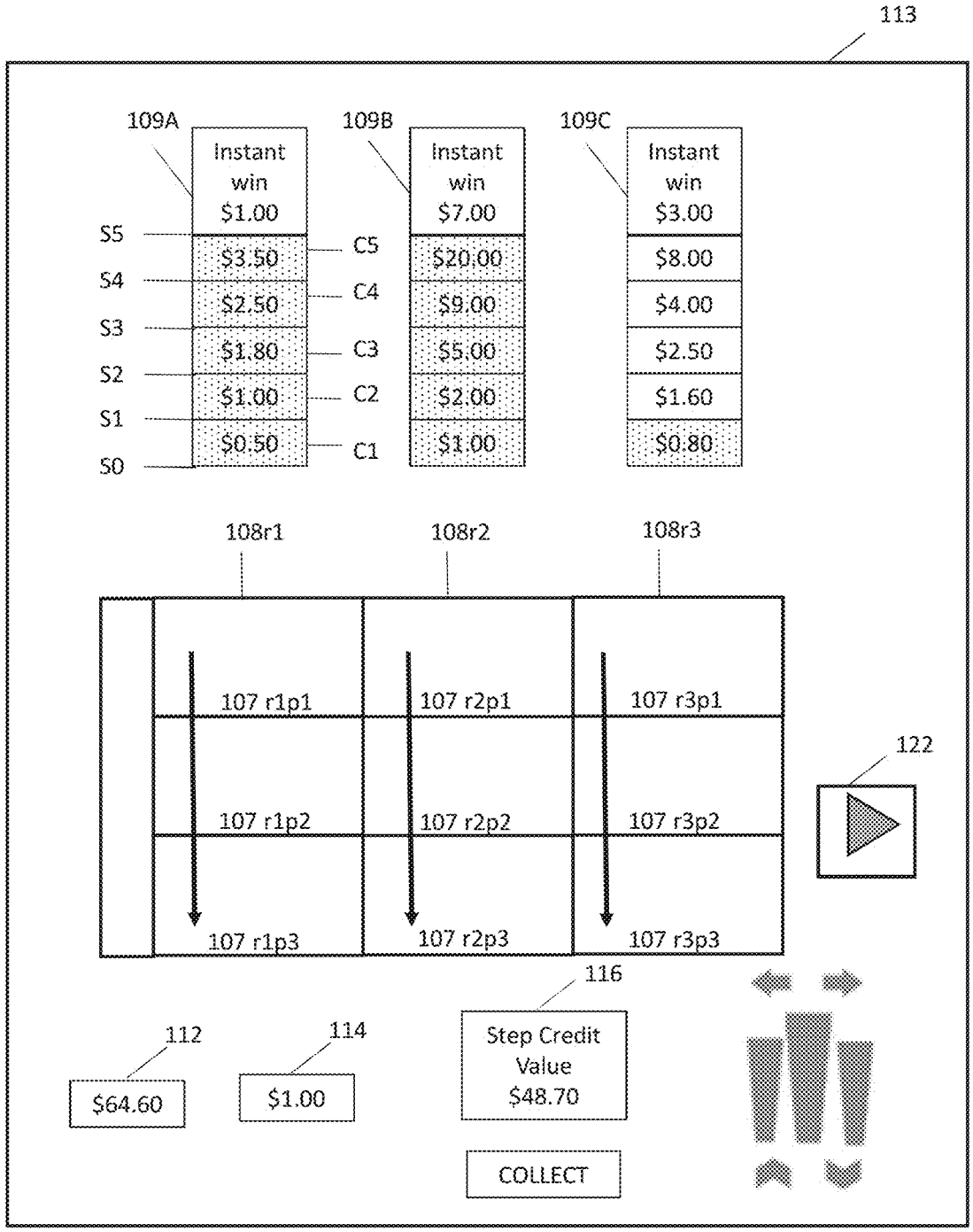
Figure 4C:
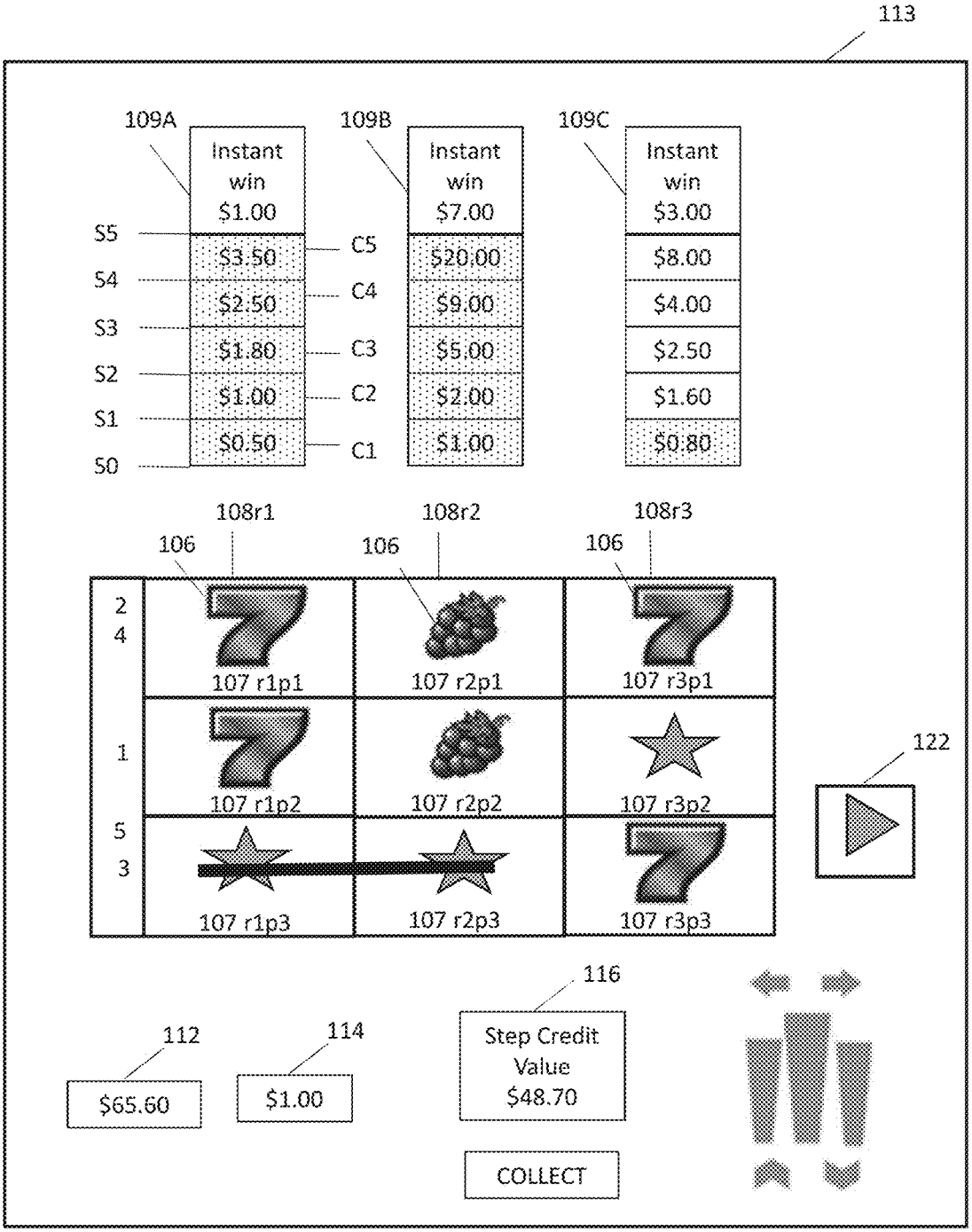

FIGS. 4A to 4C show schematic illustrations of examples of play of a game executed by the gaming device 100 already described in connection with FIGS. 1A to 3D.

As shown in FIG. 4A, the player may cause a user-initiated update, which may cause user-initiated forward progression of one or more steps along the steps of the one or more progression structures 109A, 109B, 109C. For example, the player may voluntarily transfer credit value from the credit balance. As shown in FIG. 4A, the player may transfer credit to steps S4 and S5 of ladder 109B from the credit balance. Furthermore, the player may transfer credit to steps S1 to S5 of ladder 109A from the credit balance. The credit balance of the credit meter 111 may be updated to $64.60 and the step credit value balance may be updated to $48.70.

The control arrangement 101 may be configured to allow or decline the forward progression along the steps of the selected progression structure based on the credit balance of the credit meter 111. For example, based on the user input, the control arrangement 101 may determine that at least $9.00+$20.00=$29.00 is needed in the credit balance of the credit meter. The control arrangement 101 may determine that the credit balance of the credit meter 111 is sufficient and may allow the forward progression along the one or more steps of the selected progression structure, and allow the associated deduction from the credit meter.

It may be understood that before initiating the subsequent play, the player may initiate a backward progression or a forward progression of one or more steps along the steps of the selected progression structure. Optionally, the control arrangement 101 may be configured to cause user-initiated backward progression along the steps of at least one progression structure of the one or more selected progression structures, and user-initiated forward progression along the steps of at least one further selected progression structure of the one or more selected progression structures.

Since in the example of FIG. 4A, the user-initiated update causes the user to obtain the maximum progression status at the first progression structure 109A and the second progression structure 109B (S5), the player may potentially win a further award and/or bonus on a subsequent play of the game. Each progression structure may have a respective award that may be earned if the progression status of the respective progression structure is at the maximum progression status.

As shown in FIG. 4B, the player may trigger the subsequent play of a game (e.g. by pressing play 122).

As shown in FIG. 4C, two "star" symbols were randomly generated along pay line 3. The control arrangement 101 (e.g. the progression determination circuitry) may determine that a game-based progression of two steps along the first progression structure 109A is to be updated. However, the first progression structure 109A is full. The player may be rewarded with an instant win ($1.00), which may be added to the credit balance of the credit meter 111.

Figure 5A:
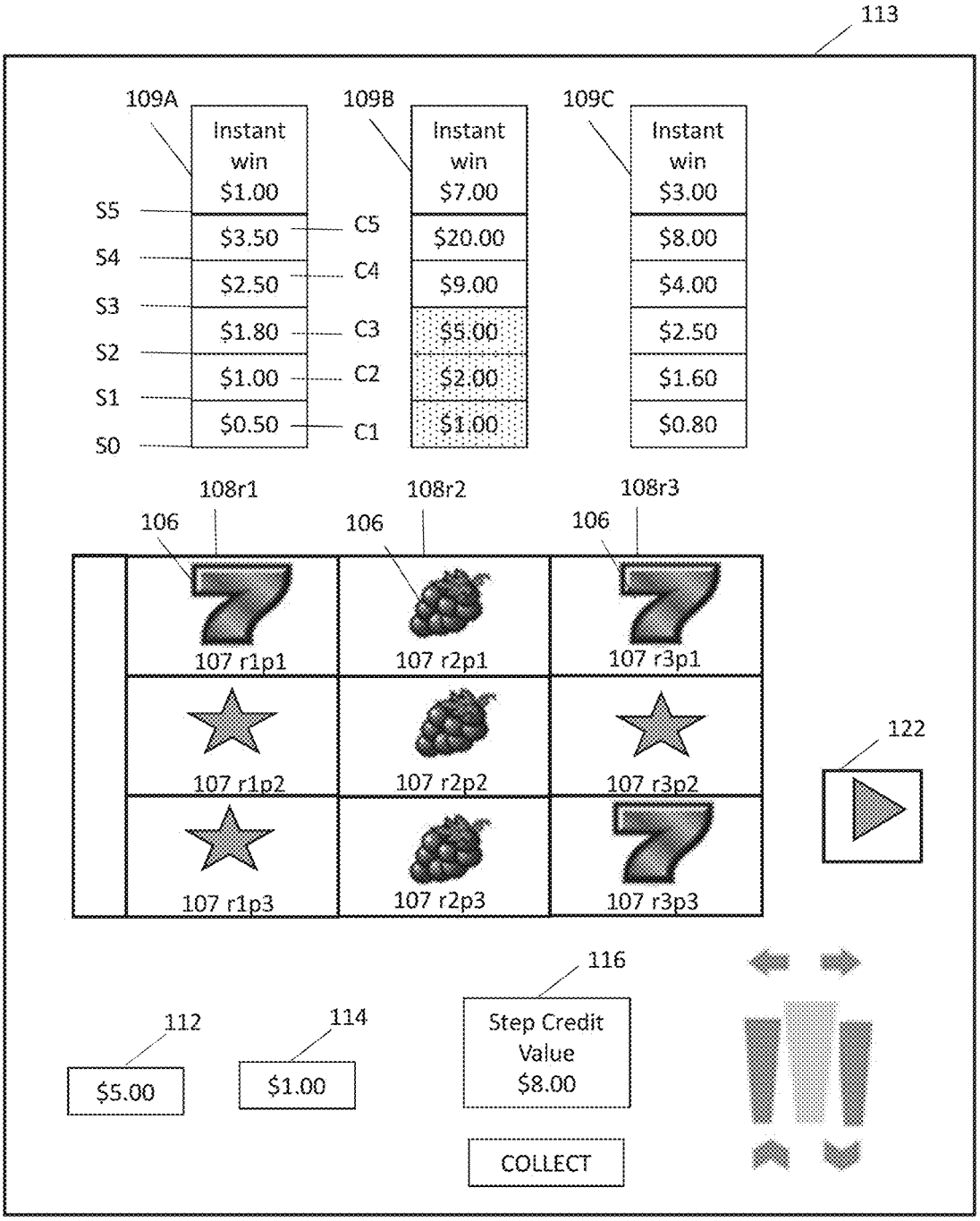
FIGS. 5A to 5B show schematic illustrations of further examples of play of a game executed by the gaming device according to various embodiments.

FIG. 5A shows a schematic illustration of an example of play of a game executed by the gaming device 100 already described in connection with FIGS. 1A to 4C.

As shown in FIG. 5A, the player may attempt to transfer credit value from the credit meter 111 to the step credit balance 116 to earn user-initiated progression of step s4 of the second progression structure 109B. However, the player needs $9 to cause the progression, but only has $5.00 in the credit balance. The control arrangement 101 may be configured to decline the user-initiated forward progression along the steps of the selected progression structure if the credit balance of the credit meter is below a threshold value. For example, the control arrangement may be configured to decline the user-initiated forward progression due to the insufficient credit balance in the credit meter 111.

Figure 5B:
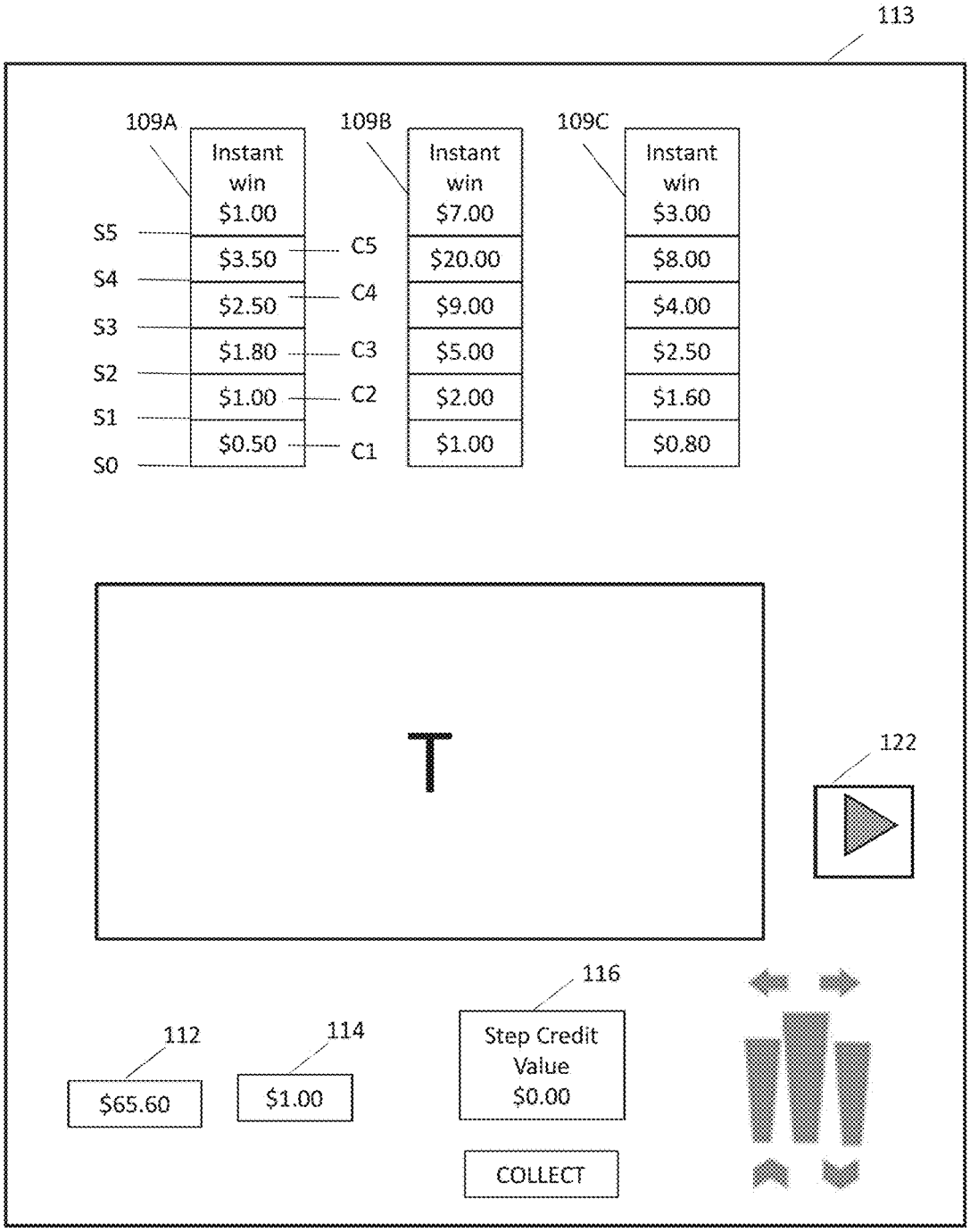

FIG. 5B shows a schematic illustration of examples of play of a game executed by the gaming device 100 already described in connection with FIGS. 1A to 5A. The plurality of symbols that may occur may include at least one regression symbol (e.g. a terminator symbol). The occurrence of the at least one regression symbol may cause a backward progression along the steps of the plurality of progression structures by a predetermined number of steps. The at least one regression symbol may include a terminator symbol. The occurrence of the terminator symbols may cause the backward progression to a starting position of all the progression structures of the plurality of progression structures 109.

For example, the player may trigger a subsequent play of a game (e.g. by pressing play). As shown in FIG. 5B, a regression or terminator symbol "T" has appeared. The player may lose any progress that has been made on the progression structures. In other words, the progression status of all the progression structures may be reset to step or level 0 (s0). In addition, the step credit control circuitry may be configured to update the step credit balance based on the backward progression caused by the at least one regression symbol combination. For example, the step credit value balance may be updated to $0.00. Since the step credit value balance $0.00, the player may be allowed to change the wager 114 if he so wishes. Therefore, control arrangement 101 may be configured to determine whether a wager 114 may be changed based on the step credit value balance.

Figure 6A:
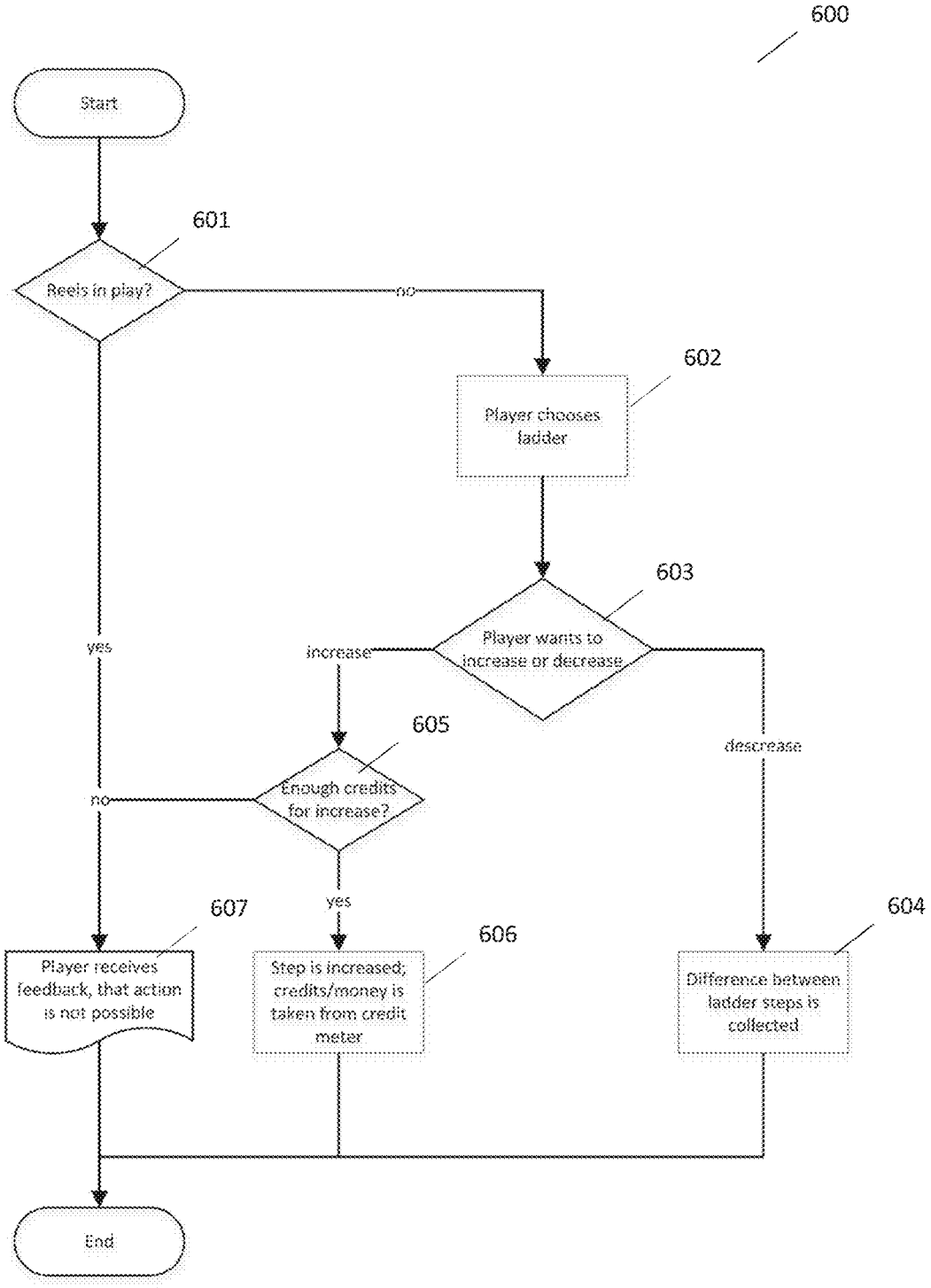
FIG. 6A shows a flow chart of method of operating a gaming device according to various embodiments.

FIG. 6A shows a flow chart of method of operating the gaming device. The method may include one or more or all of the features of the gaming device and the play of the game already described in connection with FIGS. 1A to 5B.

The control arrangement 101 may determine (step or process 601) whether the reels are in play. If the reels are not in play, the player may be allowed to choose a ladder (step or process 602). The player may be allowed to input selections to increase or decrease (step or process 603) the progression on the ladder. If the player selects to decrease the steps of the ladder, the difference between the ladder steps may be collected to the credit meter (step or process 604). If the player selects to increase the steps of the ladder, a check is carried as to whether there are enough credits for the increase (step or process 605). If there are sufficient credits for the increase, the step is increased, and credit/money is taken from the credit meter (step or process 606). If there are insufficient credits for the increase, the player receives feedback that action is not possible (step or process 607). If the reels are in play, the player receives feedback that action is not possible (step or process 607).

Figure 6B:
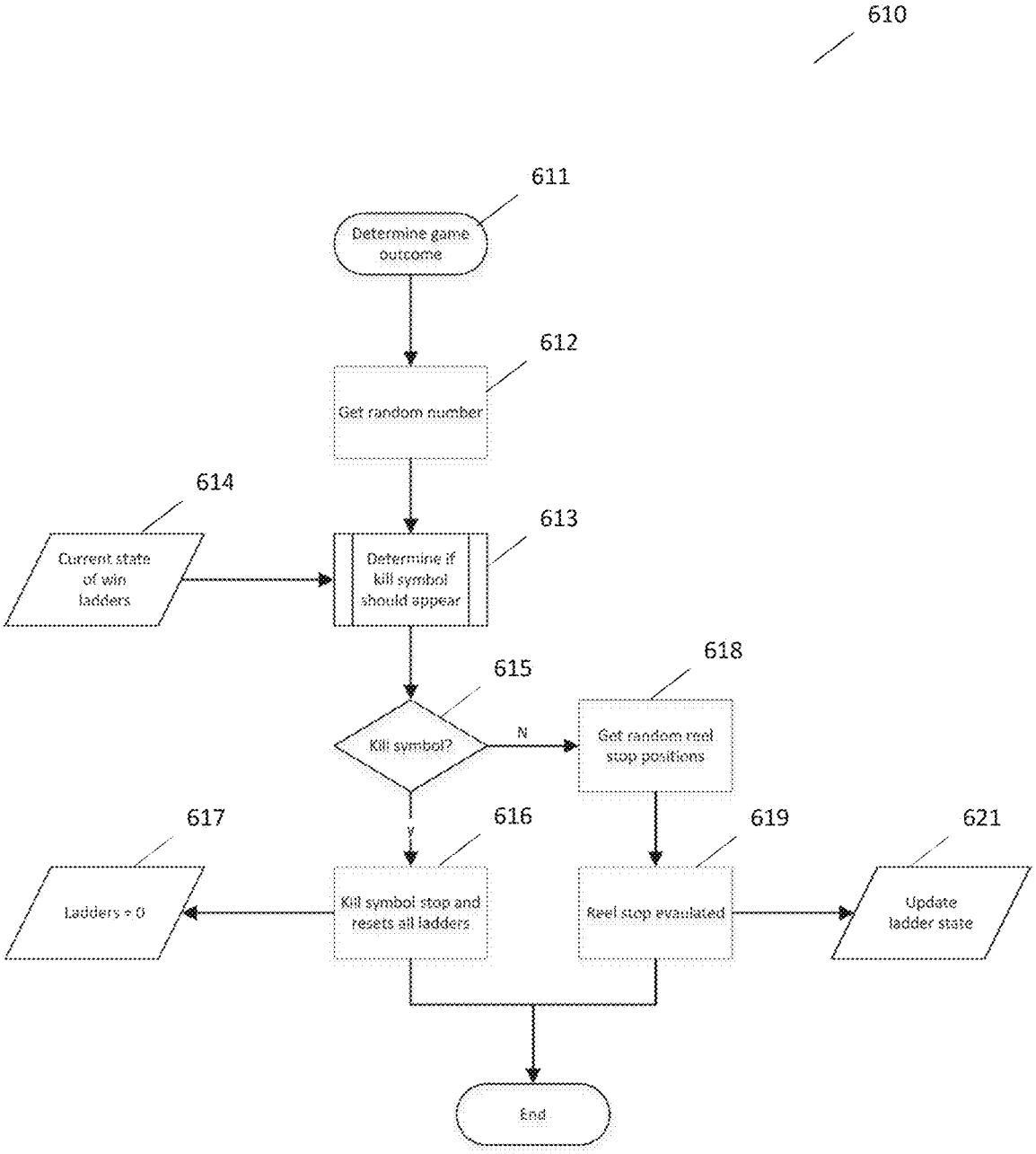
FIG. 6B shows a further flow chart of method of operating a gaming device according to various embodiments.

FIG. 6B shows a flow chart of method 610 of operating the gaming device. The method may include one or more or all of the features of the gaming device and the play of the game already described in connection with FIGS. 1A to 6A.

The method 610 may include determining (step or process 611) by the control arrangement 101, a game outcome. The method 610 may include obtaining or getting (step or process 612) one or more random numbers by one or more random number generators. The method 610 may further include a decision process, which may include or may be determining whether a terminator or kill symbol should appear (step or process 615). Whether or not a terminator or kills symbol appears may be based on a current state of the win ladders 614, such as based on the player's interaction with the progression ladders, which may directly or indirectly influence the probability of the appearance of the kill symbol. In this regard, the volatility of the game may be influenced based on the player's interaction with the progression ladders. Thus, the ladder state may influence or play a role in calculating the game outcome. If the kill symbol does appear (Y=yes), the kill symbol may stop and reset all ladders (step or process 616). The ladders may be reset to a reset level, such as zero (step or process 617). If the kill symbol does not appear (N=no), the the method 610 may include obtaining the random reel stop positions (step or process 618) and evaluating the reel stop positions (step or process 619). The method 610 may further include updating the state of the ladders (step or process 619) based on the evaluated reel stop positions.

Figure 7:
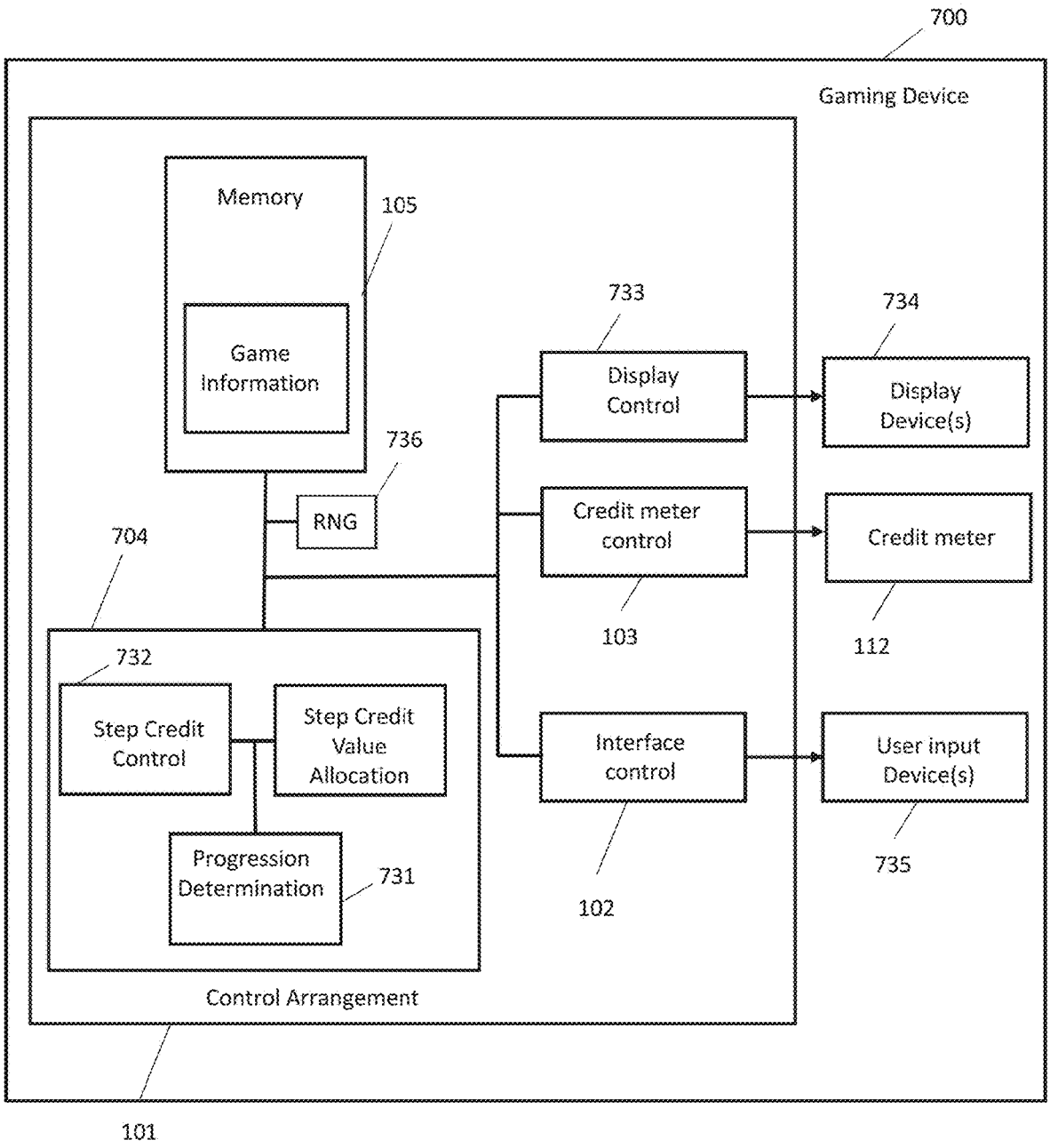
FIG. 7 shows a schematic illustration of a gaming device according to various embodiments.

FIG. 7 shows a schematic illustration of a gaming device 700 according to various embodiments. The gaming device 700 may include one or more or all of the features of the gaming device and the play of the game already described in connection with FIGS. 1A to 6B.

Optionally the gaming device may be part of a gaming system for playing a casino game. As shown in FIG. 7, the control arrangement 101 may include a processor arrangement 704 (e.g. game control circuitry) including at least one processor for executing the play of the game. The processor arrangement 704 may optionally include at least one processor. The at least one processor may be a microprocessor, a microcontroller-based platform, a suitable integrated circuit or one or more application-specific integrated circuits (ASIC's). The processor arrangement 704 may be in communication with, or operable to access or to exchange signals, with at least one data storage or memory device 105.

Memory device 105 may store program code and/or instructions, executable by the at least one processor to control the gaming device 100. Optionally, memory device 105 may store other data such as image data, event data, player input data, pay-table data or information, and applicable game rules that relate to the play of the casino game. Additionally or optionally, memory device 105 may include the game information, e.g. instructions, data, etc. for the play of the game. The gaming device 100 may be computer-based, and memory arrangement 105 may be a tangible non-transitory computer-readable memory.

The control arrangement 101 may further include a random or pseudo-random number generator 736 for causing the random generation of symbol combinations based on the plurality of symbols 106.

The control arrangement 101 may include the progression determination circuitry 731 for determining a progression status of respective progression structures of the plurality of progression structures based on at least one of game-based progression and a user-initiated update. Optionally, the progression determination circuitry 731 may be part the processor arrangement 704 or may work in connection with the processor arrangement 704.

The progression determination circuitry 731 may be coupled to the credit meter control circuitry 103 and step credit control circuitry 732. The progression determination circuitry 731 may be is configured to transmit the credit signal to the credit meter control circuitry 103 if a backward progression is caused by the user-initiated update. The credit signal may be generated by the progression determination circuitry 731 based on the step selection information. The credit signal may include instructions or information to inform the credit meter control circuitry 103 how much to deduct or add to the credit meter 111. The credit meter control circuitry 103 may be configured to update the credit balance of the credit meter 111 based on a credit signal from the progression determination circuitry 731.

Additionally or optionally, the progression determination circuitry 731 may be configured to refrain from transmitting the credit signal to the credit meter control circuitry 103 if a backward progression is caused by the occurrence of at least one regression symbol combination. In which case, no changes are made to the credit meter 111. Therefore, the credit meter control circuitry 103 may be configured to update the credit balance of the credit meter based on whether a backward progression along the steps of the progression structure is caused by the occurrence of at least one regression symbol combination or by the user-initiated update. For example, the credit meter control circuitry 103 may be configured to update the credit balance of the credit meter by one or more step credit values corresponding to one or more steps of a user-initiated backward progression, and to not update of the credit balance of the credit meter if the backward progression is caused by the occurrence of a at least one regression symbol combination.

The step credit control circuitry 732 may be configured to update the step credit balance of the step credit meter 116 based on a step credit signal from the progression determination circuitry 731. The step credit signal may be generated by the progression determination circuitry 731 based on the determined progression status of the respective progression structures.

The control arrangement may further include interface control circuitry for communicating with the user input device. The user input device may be in the form of one or more buttons (e.g. left-right buttons, and e.g. up-down buttons) which the user may use for selecting a progression structure and a number of progression steps. Alternatively, the user input device may be part of a touch-screen display device, and the interface control circuitry 102 may include or may be part of touch-screen controller circuitry coupled to the display control circuitry 733 and/or display device 734. The control arrangement 101 may further include display control circuitry 733 coupled to a display device 734 (e.g. a screen or monitor of a gaming device 700). The display control circuitry 733 may cause display of the play of the game (e.g. the plurality of symbols 106, reels 108, display positions 107), the updated credit balance of the credit meter 111 and the updated step credit balance 116 on the display device 734.

The processor arrangement 704 may be configured to select a game condition from a plurality of game conditions for a subsequent play of the game based on a progression status of respective progression structures of the plurality of progression structure. For example, each game condition of the plurality of game conditions may be associated with a probability of occurrence of symbol combinations at the plurality of symbol display positions. Thus, the probability of occurrence of symbol combinations (e.g. the "star" symbol, the "seven" symbol, the "grapes" symbol or the "T" symbol), may be varied based on the progression status of respective progression structures.

Figure 8A:
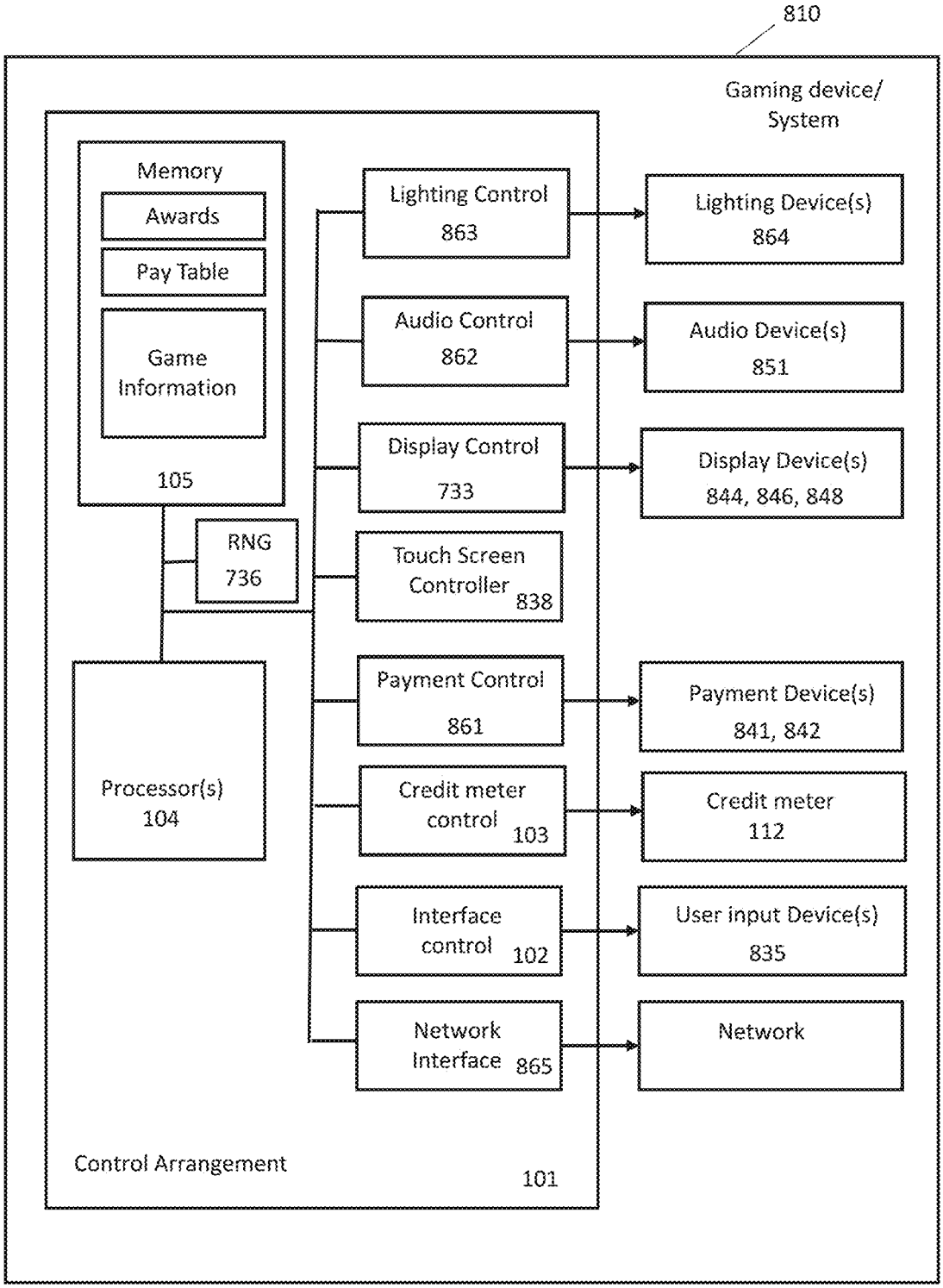
FIGS. 8A and 8B show schematic illustrations of a gaming system according to various embodiments.
Figure 8B:
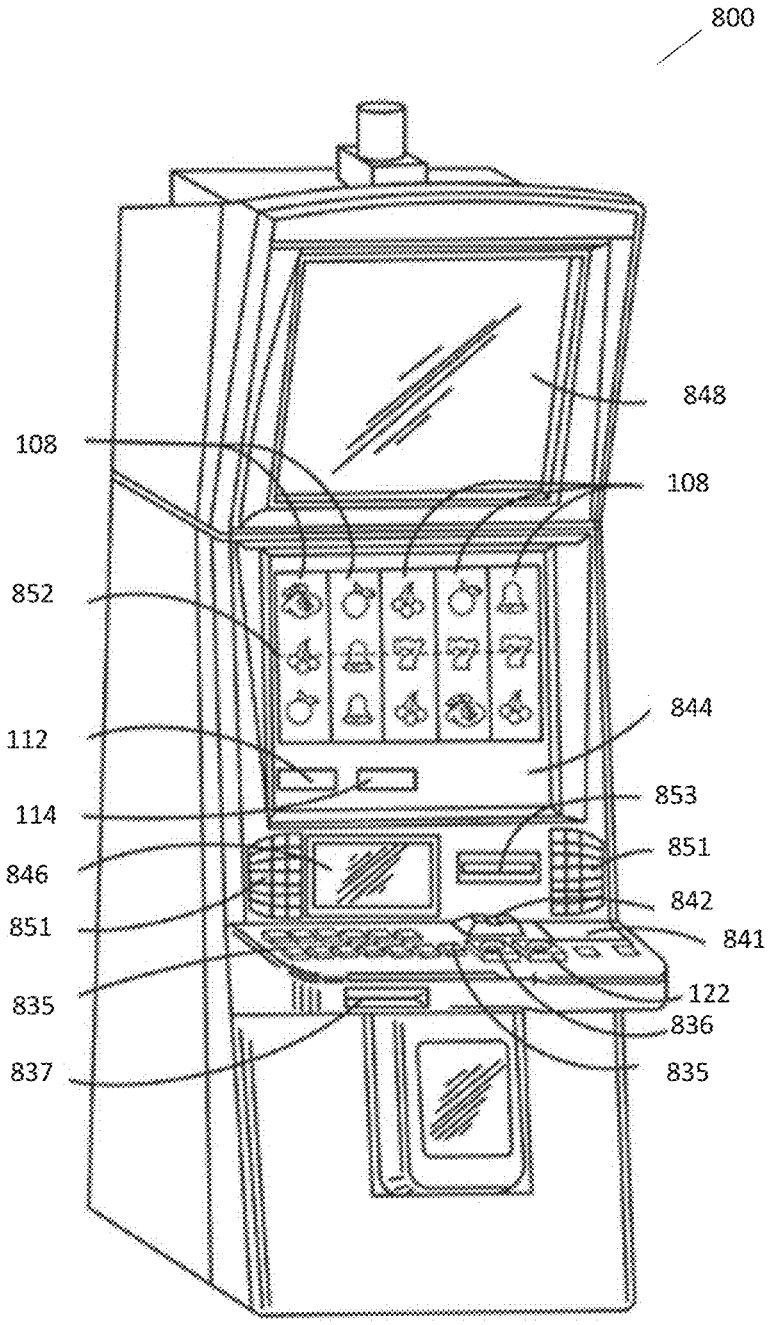

FIGS. 8A and 8B shows schematic illustrations of a gaming system 810 according to various embodiments. The gaming system 810 may include or may be gaming device 800 (shown in FIG. 8B). The gaming device 800 and/or gaming system 810 may include one or more or all of the features of the gaming device and the play of the game already described in connection with FIGS. 1A to 7.

The gaming system 810 may include the control arrangement 101, which may include game control circuitry. The game control circuitry may include at least one processor arranged 104. The control arrangement may further include interface control circuitry 102, credit meter control circuitry 103, and memory arrangement 105.

The control arrangement 101 may further include payment control circuitry 861 in communication with at least one payment device 841 of the gaming system 810/gaming device 800. The payment control circuitry 101 may be in communication with the processor arrangement 704. The payment device 841 may accept a physical item associated with a monetary value and may establish or increase a credit balance for the player based on the monetary value. The payment device may be a payment acceptor 841 including a note, ticket, card, and/or bill acceptor wherein the player inserts paper money, a ticket, or voucher, and/or a coin slot 842 where the player inserts money, coins, or tokens. Payment devices such as readers or validators for credit cards, debit cards, and/or credit slips may accept payment. A player may insert an identification card into a card reader of gaming device 800. The identification card may be a smart card having a programmed microchip, a coded magnetic strip, or coded rewritable magnetic strip, wherein the programmed microchip or magnetic strips are coded with a player's identification, credit totals (or related data), and/or other relevant information.

Optionally, a player may carry a portable device, such as a cell phone, a radio frequency identification tag, or any other suitable wireless device, which communicates a player's identification, credit totals (or related data), and other relevant information to gaming device 800. Money (or credit) may be transferred to the gaming device 800 through electronic funds transfer. It may be appreciated that if a player funds the gaming device 800, the control arrangement may include payment control circuitry for determining the amount of funds entered and displays the corresponding amount on the credit or other suitable display as described previously.

Gaming device 800 may include at least one an input device 835 in communication with the control arrangement 101. Input device(s) 835 may include any suitable device that enables the player to produce an input signal that is received by the control arrangement 101. An input device 835 may be a wager input device, such as a wager button. The player may place a bet by pushing wager button. Wager button may be a bet one button, which by selecting, the player may wager one credit (i.e., a number of credit points, dollars, cents, etc.). The player may increase the bet by one credit each time the player pushes the bet one button. In response to the player pushing the bet one button, the number of credits shown in the credit display may decrease by one, and the number of credits shown in the bet display may increase by one. Optionally, an input device 835, such as wager button, may be a bet max button, which may enable the player to bet the maximum wager. Optionally, an input device 835 may be one or more intermediate wager buttons, which may allow a player to bet one or more intermediate wagers that are permitted or accepted for a game of gaming device 800. An input device may be a cash-out button 836. The player may push cash-out button 836 and initiate a "cash-out" operation to receive a cash payment or other suitable form of payment corresponding to the number of remaining credits. Optionally, in response to the player cashing out, a payment device, such as a ticket, payment, or note generator 837 prints or otherwise generates a ticket or credit slip to provide to the player. The player receives the ticket or credit slip and may redeem the value associated with the ticket or credit slip via a cashier (or other suitable redemption system). Optionally, in response to the player cashing out, the player may receive the coins or tokens in a coin pay-out tray. Optionally, an input device may be a game activation device (e.g., a play button 122), which is used by the player to start the selected game or sequence of events in the gaming device 800. The play button can be any suitable play activator such as a bet one button, a max bet button, or a repeat the bet button. Optionally, upon appropriate funding, gaming device 800 may begin the game play of a selected game automatically. Optionally, upon the player engaging one of the play buttons, gaming device 800 automatically activates game play. Optionally, gaming device 800 may include one or more game selection devices, such one or more game selection buttons and/or one or more pull arms, which may be used by the player to select and/or start a game or sequence of events on gaming device 800.

Additionally or optionally, the gaming device 800 may include at least one card reader 853 in communication with the at least one processor 104 of the processor arrangement 704. In this embodiment, a player is issued a player identification card, which has an encoded player identification number that uniquely identifies the player. In response to a player inserting their player tracking card into the card reader to begin a gaming session, the card reader reads the player identification number off the player tracking card to identify the player. It should be appreciated that any suitable pay-out mechanism, such as funding to the player's electronically recordable identification card or smart card, may be implemented in accordance with gaming device 800.

An input device may be a touch-screen display coupled with a touch-screen controller 838 or some other touchsensitive display overlay to allow for player interaction with the images on a display device 734. Optionally, the gaming device 800 may include (e.g., a central display device 844, upper display device 848, and/or player tracking display 846). The touch-screen display and/or touch-screen controller 833 may be coupled to the video or display controller 733. A player may make decisions and input signals into gaming device 800 by touching the touch-screen at the appropriate locations.

The gaming device 800 may have a support structure, housing, or cabinet, which provides support for a plurality of displays, inputs, controls, and other features of an electronic gaming machine. Gaming device 800 may be positioned on a base or stand or can be configured as a pub-style tabletop game (not shown) which a player can operate preferably while sitting. It should be appreciated that gaming device 800 may have varying cabinet and display configurations. Optionally, the display devices may be preferably connected to or mounted on the cabinet of gaming device 800. The display devices may also serve as digital glass operable to advertise games or other aspects of the gaming establishment. Optionally, the game control circuitry including the at least one processor and/or memory device including game information may reside within the cabinet of the gaming device.

The one or more displays of the gaming device may be configured to display a credit balance, which displays a player's current number of credits, cash, account balance, or the equivalent. Additionally or optionally, the gaming device 800 may include a bet display 114, which displays a player's amount wagered. Additionally or optionally, the gaming device 800 may further include a player tracking display 846, which displays information regarding a player's play tracking status. It should be appreciated that these devices are in communication with the processor 104. The at least one display device may be a mobile display device, such as a PDA or tablet PC, that enables play of at least a portion of a game at a location remote from gaming device 800 and/or gaming device 800.

The display devices 848, 844, 846 may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. Optionally, as described in more detail below, the display device includes a touch-screen with an associated touch-screen controller. The display devices may be of any suitable size and configuration, such as a square, rectangle, elongated rectangle, oval, etc. The display devices 844, 846, 848 of gaming device 800 may be configured to display at least one game and associated images, symbols, and indicia such as any visual representation or exhibition of the movement of objects such as mechanical, virtual, or video reels and wheels, etc., and the like. Optionally, central display device 844, upper display device 848, and/or player tracking display 846 may be divided into one or more screens or sub-display devices, to display one or more games, symbols, graphics, or other images/information. Optionally, the symbols, images and indicia displayed on or of display device(s) may be in mechanical form. That is, the display device may include any electromechanical device, such as one or more mechanical objects, such as one or more rotatable wheels or reels 108 configured to display at least one or a plurality of games or other suitable images, symbols or indicia.

The gaming device 800 may further include audio control circuitry 862. At least one sound generating device (e.g. audio device 851) may be controlled by one or more sounds cards of the audio control circuitry 862. The audio control circuitry 862 may be coupled to and may function in conjunction with the at least one processor 104 and/or gaming control circuitry. Optionally, the sound generating device may include at least one speaker 851 (e.g., speakers 851 of gaming device) or other hardware and/or software for generating sounds, such as by playing music for a game(s), or by playing music for other modes of gaming device 800, such as an attract mode. The gaming device 800 may further include lighting control circuitry 863 which may be coupled to one or more lighting devices 864. The gaming device 800 may provide dynamic sounds coupled with attractive multimedia images displayed on one or more of the display devices 848, 844, 846 to provide an audio-visual representation or to otherwise display full-motion video with sound to attract players to gaming device 800. During idle periods, gaming device 800 may display a sequence of audio and/or visual attraction messages to attract potential players to gaming device 800. The videos may also be customized to provide any appropriate information.

The gaming device 800 may further include a network interface control circuitry 865, which may connect the gaming device 800 to one, or more external devices via a communication network (e.g. a wired or wireless). The gaming device 800 may further include a plurality of communication ports for enabling communication of the processor with external peripherals, such as external video sources, expansion buses, game or other displays, a SCSI port, or a keypad.

Gaming device 800 may incorporate any suitable wagering game(s). Gaming device 800 may include some or all of the features of conventional gaming machines or devices (e.g., slot machines). A game(s) on gaming device 800 may be any suitable reel-type game susceptible to representation in an electronic or electromechanical form, which may produce a random outcome based on pay-out probability data at the time of or after placement of a wager. Alternatively, game(s) may be a video poker game, a video bingo or keno game, a Class II game displayed using Class III visual elements (e.g., a video slot game that uses a bingo-based ball call), or any other suitable game. A game played on gaming device 800 may be a slot game with one or more pay lines 852. Pay lines may be horizontal, vertical, circular, diagonal, angled or any combination thereof. Optionally, the gaming device includes at least one reel 108, for example, three to five reels, in either electromechanical form with mechanical rotating reels or video form with simulated reels and movement thereof. Optionally, an electromechanical slot machine includes a plurality of adjacent, rotatable reels, which may be combined and operably coupled with an electronic display of any suitable type. Optionally, if reels 108 are in video form, one or more of display devices 848, 844, 846, as described above, may display the plurality of simulated video reels 108. Each reel 108 may include and display a plurality of indicia or symbols, such as bells, hearts, fruits, numbers, letters, bars, or other images, which preferably correspond to a theme associated with the gaming device. Optionally, one or more of reels 108 are independent reels or unisymbol reels. In such embodiments, each independent or unisymbol reel generates and displays one symbol to the player. Optionally, gaming device 800 may award prizes after reels 108 of the game(s) stop spinning if specified types and/or configurations of indicia or symbols occur on an active pay line or otherwise occur in a winning pattern, occur on the requisite number of adjacent reels, and/or occur in a scatter pay arrangement.

Optionally, in addition to winning credits or other awards in a game on gaming device 800, the gaming device may also give players the opportunity to win credits in a bonus or secondary round of a game. The bonus or secondary round enables the player to obtain a prize or pay-out in addition to the prize or payout, if any, obtained from the base or primary round of the game. In general, a bonus or secondary round produces a significantly higher level of player excitement than the base or primary round of the game because it provides a greater expectation of winning than the base or primary round, and is accompanied with more attractive or unusual features than the base or primary round. It should be appreciated that, in one embodiment, the bonus or secondary round is similar to the base or primary round.

Figure 8C:
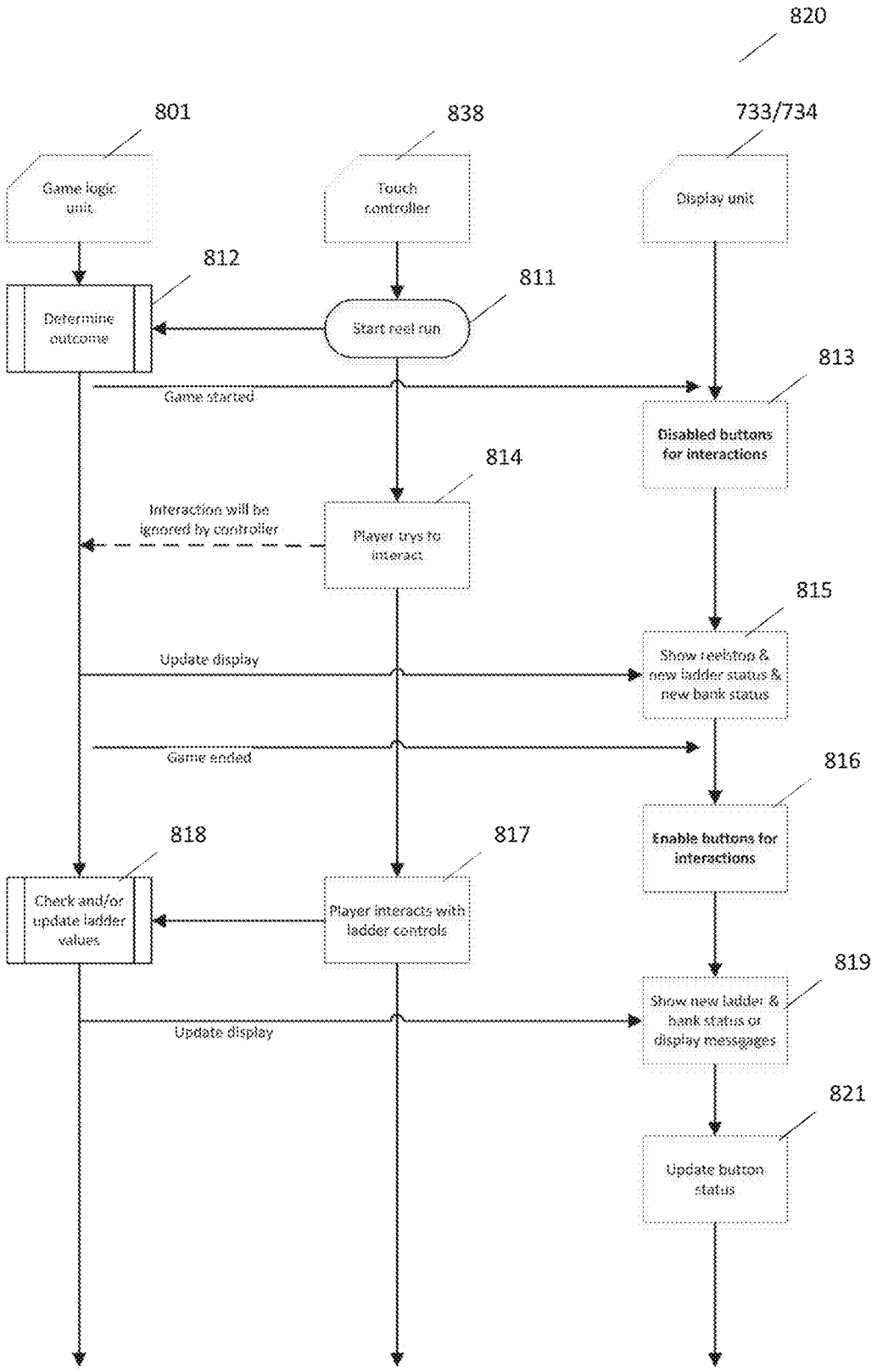
FIG. 8C shows a flow chart of method for operating components of a gaming device according to various embodiments.

FIG. 8C shows a flow chart of method 820 for operating components of a gaming device according to various embodiments. The method may include one or more or all of the features of the gaming device and the play of the game already described in connection with FIGS. 1A to 8B. The method 820 shows the interaction between the display control circuitry 733/734, a touch controller 838 and a game logic unit 801 of the gaming device. The game logic unit 801 may refer to or may include one or more portions of control arrangement 101 for controlling the play of the game. For example, the game logic unit 801 may include at least one processor 104 and a memory arrangement 105 for storing a plurality of instructions, which when executed by the at least one processor 104, causes the control arrangement 101 to cause play of a game. The game logic unit 801 may optionally include, or may be communicatively coupled with RNG circuitry 736.

The method 820 may include receiving an input signal from a touch controller 838 to start a reel run (step or process 811). The method 820 may include the game logic unit 801 determining an outcome (step or process 812), such as determining that a game is to be started. The game logic unit 801 may be configured to start the game. The method 820 may include disabling buttons of the display unit 733/734 and/or touch controller 838 for interactions after the game logic unit 801 determines that a game is to be started (step or process 813). If the player tries to interact with the touch controller 838, the interaction will be ignored by the game logic unit 801. The method 820 may further include sending a signal from the game logic unit 801 to the display control circuitry 733/734 to update the display device 734. In step or process 815, the updated display device 734 may show the reels start and/or stop, new ladder status (progression status) and new bank status (credit balance and step credit balance). The method 820 may further include determining by the game logic unit 801 that the game has ended after the reels stop and the progression status, credit balance and step credit balance have been updated. The game logic unit 801 may be configured to send a signal to the display unit 733/734 and/or touch controller 838 to enable buttons for interactions (step or process 816). The method 820 may include (in step or process 817) the player interacting with the ladder controls of the touch controller 838 to check and/or update ladder values (step or process 818). The game logic unit 801 may receive one or more signals from the touch controller 838 based on the player interactions. The game logic unit 801 may send a signal to the display control circuitry 733/734 to show a new ladder status (e.g. update the progression status), new bank status (update the credit balance and step credit balance) and/or display messages (step or process 819) after receiving the one or more signals from the touch controller 838. The method 820 may further include controlling or managing an update status of the one or more input means (e.g. updating the button status and/or the status of the selection symbols) (step or process 821). The controlling or managing the update status may be based on the control circuitry detecting and update of at least one of the progression status, the credit balance, the step credit balance and the display messages.

Controlling or managing the update status of the one or more input means may include enabling or disabling the one or more buttons or one or more selection symbols based on the progression status of the one or more progression structures and/or the credit balance 112. For example, if the player has collected everything (e.g. transferred all the step credit values from the progression structures so that the progression structure are empty or reset), then the collect button or selection symbol (or any or all buttons referring to collect) may be disabled. For example, the collection symbol and/or the selection symbol (e.g. 129D) of the second group of selection symbols for selecting backward progression may be disabled. Additionally or optionally, if a progression structure is full, the selection symbol (e.g. 129U) of the second group of selection symbols for selecting forward progression may be disabled. Thus, the status of the second group of selection symbols may be controlled based on the progression status of the one or more progression structures.

Additionally or optionally, if a progression structure (e.g 109B) is full, the selection symbol (129B) associated with the full progression structure (e.g. 109B) may be disabled. Thus, the status of the first group of selection symbols may be controlled based on the progression status of the one or more progression structures.

Additionally or optionally, if the credit balance of the credit meter is below a threshold value (e.g. empty), the selection symbol (e.g. 129U) of the second group of selection symbols for selecting forward progression may be disabled. Thus, the status of the second group of selection symbols may optionally also be controlled based on the credit balance 112. For example, optionally if the credit balance of the credit meter is below a threshold value (e.g. empty), and all the progression structures are full, the selection symbol (e.g. 129U) of the second group of selection symbols for selecting forward progression may be disabled.

Figure 9:
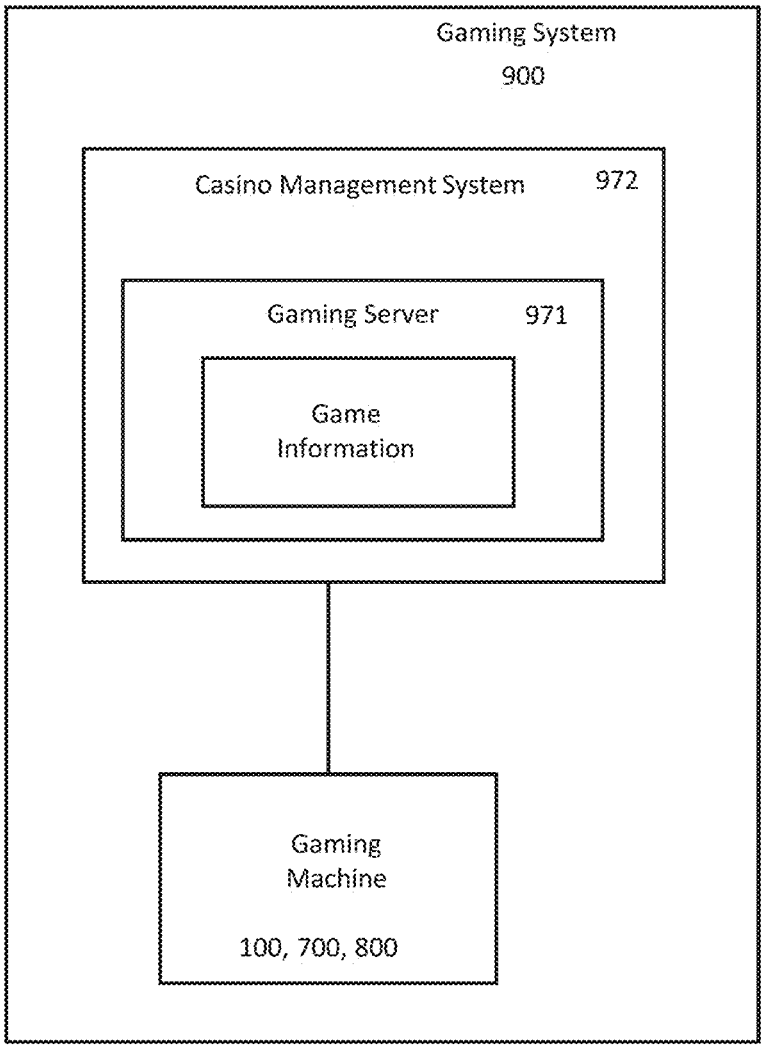
FIG. 9 shows a schematic illustration of a gaming system according to various embodiments.

FIG. 9 shows a schematic illustration of a gaming system 900 according to various embodiments. The gaming system 900 may include one or more or all of the features of the gaming device and the play of the game already described in connection with FIGS. 1A to 8B.

The gaming system may include a gaming machine 100, 700, 800. Alternatively or optionally, a memory device (e.g. computer-readable storage medium) including game information may be stored on a gaming server 971. The gaming server 971 may be in communication with a plurality of gaming machines (user console arrangements) via a communication network. The user console arrangement may include a display device or arrangement for the display of the play of the game, a user input interface for accepting user input selections, and a credit meter. Additionally or optionally, the gaming server 971 may be part of a casino gaming or management system 972.

The following examples pertain to further embodiments, from which numerous permutations and configurations will be apparent, and whose scope of subject-matter is defined by the appended claims.

Various examples relate to a gaming device. The gaming device comprises a control arrangement. The control arrangement comprises interface control circuitry for communication with a user input interface. The control arrangement comprises credit meter control circuitry for controlling a credit meter. The control arrangement comprises at least one processor and a memory arrangement for storing a plurality of instructions, which when executed by the at least one processor, causes the control arrangement to:

cause play of a game comprising a display of a plurality of symbols at a plurality of symbol display positions of a plurality of reels, and display of a plurality of progression structures, wherein a progression structure comprises a plurality of steps, wherein each step is associated with a step credit value;

cause game-based progression along the steps of the plurality of progression structures based on the occurrence of symbol combinations of the plurality of symbols at at least one of the plurality of symbol display positions, receive, via the interface control circuitry, credit value transfer information for causing a user-initiated update of a progression structure of the plurality of progression structures, wherein the credit value transfer information comprises progression structure identity information identifying a selected progression structure, and step selection information identifying one or more selected steps of the selected progression structure to be updated; and cause the user-initiated update of the selected progression structure and the credit meter based on the credit value transfer information.

According to various embodiments, the control arrangement is configured to cause the user-initiated update of the selected progression structure independently of other progression structures of the plurality of progression structures.

According to various embodiments, wherein the user-initiated update comprises an update of the credit meter based on one or more step credit values of the one or more selected steps of the selected progression structure.

According to various embodiments, the step selection information comprises a quantity of steps of the selected progression structure to be updated, wherein the control arrangement is configured to cause the user-initiated update of the selected progression structure by the quantity of steps.

According to various embodiments, the quantity of selected steps ranges from one to the total number of steps of the selected progression structure.

According to various embodiments, each progression structure of the plurality of progression structures comprises a different total number of steps.

According to various embodiments, the user-initiated update causes a user-initiated backward progression or a user-initiated forward progression of one or more steps along the steps of the selected progression structure, wherein the user-initiated backward progression is further associated with an addition of one or more step credit values corresponding to the one or more steps to the credit meter, and wherein the user-initiated forward progression is further associated with a deduction of one or more step credit values corresponding to the one or more steps from the credit meter.

According to various embodiments, the control arrangement is configured to allow or decline the forward progression along the steps of the selected progression structure based on a credit balance of the credit meter.

According to various embodiments, the control arrangement is configured to decline the user-initiated forward progression along the steps of the selected progression structure if the credit balance of the credit meter is below a threshold value.

According to various embodiments, the credit value transfer information comprises progression structure identity information identifying one or more selected progression structures of the plurality of progression structures to be updated, and respective step selection information for each respective selected progression structure of the one or more selected progression structures.

According to various embodiments, the control arrangement is configured to cause a user-initiated update to the respective selected progression structures based on the respective step selection information.

According to various embodiments, the control arrangement is configured to cause user-initiated backward progression along the steps of at least one progression structure of the one or more selected progression structures, and user-initiated forward progression along the steps of at least one further progression structure of the one or more selected progression structures.

According to various embodiments, the control arrangement is configured to cause the user-initiated update of one or more selected progression structures of the plurality of progression structures, wherein the number of selected progression structures is less than the total number of progression structures of the plurality of progression structures.

According to various embodiments, the control arrangement is configured to: receive a wager for the play of a game; assign step credit values to the steps of the plurality of progression structures based on the wager; and cause display of a randomly generated symbol combination of the plurality of symbols after assigning the step credit values to the steps of the plurality of progression structures.

According to various embodiments, the control arrangement is further configured to receive the credit value transfer information between the play of the game and a subsequent play of the game.

According to various embodiments, the control arrangement comprises progression determination circuitry for determining a progression status of respective progression structures of the plurality of progression structures. The progression determination circuitry is coupled to the credit meter control circuitry and step credit control circuitry. The credit meter control circuitry is configured to update the credit balance of the credit meter based on a credit signal from the progression determination circuitry, wherein the credit signal is based on the step selection information. The step credit control circuitry is configured to update a step credit balance of a step credit meter based on a step credit signal from the progression determination circuitry, wherein the step credit signal is based on the determined progression status of the respective progression structures.

According to various embodiments, the progression status of at least one respective progression structure is based on the user-initiated update.

According to various embodiments, the control arrangement comprises game control circuitry for executing the play of the game, wherein the game control circuitry is configured to select a game condition from a plurality of game conditions for a subsequent play of the game based on a progression status of respective progression structures of the plurality of progression structure.

According to various embodiments, each game condition of the plurality of game conditions is associated with a probability of occurrence of symbol combinations at the plurality of symbol display positions.

According to various embodiments, the control arrangement comprises step credit value allocation circuitry for assigning step credit values to the steps of the plurality of progression structures based on a received wager. The control arrangement comprises progression determination circuitry for determining a progression status of respective progression structures of the plurality of progression structures based on at least one of game-based progression and a user-initiated update. A volatility of a subsequent game is based on step credit values corresponding to the determined progression status of the respective progression structures.

According to various embodiments, the plurality of symbols comprises at least one regression symbol, wherein the occurrence of the at least one regression symbol causes a backward progression along the steps of the plurality of progression structures, and the step credit control circuitry is configured to update a step credit balance based on the backward progression caused by the at least one regression symbol combination.

According to various embodiments, the at least one regression symbol comprises a terminator symbol, and wherein the occurrence of the terminator symbols causes the backward progression to a starting position of the plurality of progression structures.

According to various embodiments, the control arrangement comprises progression determination circuitry for determining a progression status of respective progression structures of the plurality of progression structures based on at least one of game-based progression and a user-initiated update. The progression determination circuitry is configured to transmit the credit signal to the credit meter control circuitry if a backward progression is caused by the user-initiated update, and to refrain from transmitting the credit signal if a backward progression is caused by the occurrence of at least one regression symbol combination.

According to various embodiments, the credit meter control circuitry is configured to update the credit balance of the credit meter based on whether a backward progression along the steps of the progression structure is caused by the occurrence of at least one regression symbol combination or by the user-initiated update.

According to various embodiments, the credit meter control circuitry is configured to update the credit balance of the credit meter by one or more step credit values corresponding to one or more steps of a user-initiated backward progression, and to not update of the credit balance of the credit meter if the backward progression is caused by the occurrence of a at least one regression symbol combination.

According to various embodiments, wherein the control arrangement comprises display control circuitry for causing display of the play of the game, the updated credit balance and the updated step credit balance on a display device.

Various embodiments relate to a method for operating a gaming device. The method includes causing play of a game including a display of a plurality of symbols at a plurality of symbol display positions of a plurality of reels, and display of a plurality of progression structures, wherein a progression structure includes a plurality of steps, wherein each step is associated with a step credit value. The method further includes causing game-based progression along the steps of the plurality of progression structures based on the occurrence of symbol combinations of the plurality of symbols at at least one of the plurality of symbol display positions. The method further includes receiving, via interface control circuitry, credit value transfer information for causing a user-initiated update of a progression structure of the plurality of progression structures. The credit value transfer information includes progression structure identity information identifying a selected progression structure, and step selection information identifying one or more selected steps of the selected progression structure to be updated. The method further includes causing the user-initiated update of the selected progression structure and the credit meter based on the credit value transfer information.

According to various examples, the method further includes causing the user-initiated update of the selected progression structure independently of other progression structures of the plurality of progression structures.

According to various examples, the user-initiated update causes a user-initiated backward progression or a user-initiated forward progression of one or more steps along the steps of the selected progression structure. The user-initiated backward progression is further associated with an addition of one or more step credit values corresponding to the one or more steps to the credit meter, and the user-initiated forward progression is further associated with a deduction of one or more step credit values corresponding to the one or more steps from the credit meter.

According to various examples, the method includes allowing the forward progression along the steps of the selected progression structure based on a credit balance of the credit meter.

According to various examples, the method includes declining the user-initiated forward progression along the steps of the selected progression structure if the credit balance of the credit meter is below a threshold value.

According to various examples, the credit value transfer information includes progression structure identity information identifying one or more selected progression structures of the plurality of progression structures to be updated, and respective step selection information for each respective selected progression structure of the one or more selected progression structures.

According to various examples, the method includes causing a user-initiated update to the respective selected progression structures based on the respective step selection information.

According to various examples, the method includes causing user-initiated backward progression along the steps of at least one progression structure of the one or more selected progression structures, and user-initiated forward progression along the steps of at least one further progression structure of the one or more selected progression structures.

According to various examples, the method includes receiving a wager for the play of a game. The method includes assigning step credit values to the steps of the plurality of progression structures based on the wager. The method includes causing display of a randomly generated symbol combination of the plurality of symbols after assigning the step credit values to the steps of the plurality of progression structures.

According to various examples, the method includes selecting a game condition from a plurality of game conditions for a subsequent play of the game based on a progression status of respective progression structures of the plurality of progression structure.

Various embodiments relate to a computer-readable storage medium storing a plurality of instructions, which when executed by a processor, causes the processor to perform the method of any of the described embodiments.

The aspects and features described in relation to a particular one of the previous examples may be combined with one or more of the further examples to replace an identical or similar feature of that further example or to additionally introduce the features into the further example.

The methodologies described herein may be implemented by various means depending upon applications according to particular examples. For example, such methodologies may be implemented in hardware, firmware, software, or combinations thereof. In a hardware implementation, for example, the controller or processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Unless specifically stated otherwise, as apparent from the discussion herein, it is appreciated that throughout this specification discussions utilizing terms such as "processing," "computing," "calculating," "determining" or the like refer to actions or processes of a processor, such as a processor on a special purpose computer or a similar special purpose electronic computing device. In the context of this description, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

For clarity in discussing the various functions of the system, multiple computers and/or servers are discussed as performing different functions. These different computers (or servers) may, however, be implemented in multiple different ways such as modules within a single computer, as nodes of a computer system, etc. The functions performed by the system (or nodes or modules) may be centralized or distributed in any suitable manner across the system and its components, regardless of the location of specific hardware. Furthermore, specific components of the system may be referenced using functional terminology in their names. The function terminology is used solely for purposes of naming convention and to distinguish one element from another in the following discussion. Unless otherwise specified, the name of an element conveys no specific functionality to the element or component. It should be appreciated that, optionally, the software, hardware, and associated components of the system may be programmed and configured to implement one or more embodiments described herein. It should also be appreciated that the various aspects of the system may be exemplified as software, modules, nodes, etc., of a computer or server.

The gaming systems and methods described herein may be implemented in various configurations for gaming machines, gaming devices, or gaming systems, including but not limited to: (1) a dedicated gaming machine, gaming device, or gaming system wherein the computerized instructions for controlling any games (which may be provided by the gaming machine or gaming device) are provided with the gaming machine or gaming device prior to delivery to a gaming establishment; and (2) a changeable gaming machine, gaming device, or gaming system wherein the computerized instructions for controlling any games (which may be provided by the gaming machine or gaming device) are downloadable to the gaming machine or gaming device through a data network after the gaming machine or gaming device is in a gaming establishment. Optionally, the computerized instructions for controlling any games are executed by at least one central server, central controller, or remote host. In such "thin client" embodiments, the central server remotely controls any games (or other suitable interfaces) and the gaming system is utilized to display such games (or suitable interfaces) and/or receive one or more inputs or commands from a player. Optionally, the computerized instructions for controlling any games are communicated from the central server, central controller, or remote host to a gaming device local processor and memory devices. In such "thick client" embodiments, the gaming device local processor executes the communicated computerized instructions to control any games (or other suitable interfaces) provided to a player.

Examples may further be or relate to a (computer) program including a program code to execute one or more of the above methods when the program is executed on a computer, processor or other programmable hardware component. Thus, steps, operations or processes of different ones of the methods described above may also be executed by programmed computers, processors or other programmable hardware components. Examples may also cover program storage devices, such as digital data storage media, which are machine-, processor- or computer-readable and encode and/or contain machine-executable, processor-executable or computer-executable programs and instructions. Program storage devices may include or be digital storage devices, magnetic storage media such as magnetic disks and magnetic tapes, hard disk drives, or optically readable digital data storage media, for example. They may include any type of disk including floppy disks, optical disks, solid state drives (SSDs), compact disk read-only memories (CD-ROMs), compact disk rewritables (CD-RWs), and magneto-optical disks, semiconductor devices such as read-only memories (ROMs), random access memories (RAMs) such as dynamic random access memories (DRAMs), static random access memories (SRAMs), erasable programmable read-only memories (EPROMs), flash memories, electrically erasable programmable read-only memories (EEPROMs), magnetic or optical cards, or any other type of media suitable for storing electronic instructions. Other examples may also include computers, processors, control units, (field) programmable logic arrays ((F)PLAs), (field) programmable gate arrays ((F)PGAs), graphics processor units (GPU), application-specific integrated circuits (ASICs), integrated circuits (ICs) or system-on-a-chip (SoCs) systems programmed to execute the steps of the methods described above.

The terms "circuit" and "circuitry" are used interchangeably herein. As used herein, these terms and the term "logic" are used to refer to alone or in any combination, analog circuitry, digital circuitry, hard wired circuitry, programmable circuitry, processor circuitry, microcontroller circuitry, hardware logic circuitry, state machine circuitry and/or any other type of physical hardware and/or software component.

It is further understood that the disclosure of several steps, processes, operations or functions disclosed in the description or claims shall not be construed to imply that these operations are necessarily dependent on the order described, unless explicitly stated in the individual case or necessary for technical reasons. Therefore, the previous description does not limit the execution of several steps or functions to a certain order. Furthermore, in further examples, a single step, function, process or operation may include and/or be broken up into several sub-steps, -functions, -processes or -operations.

If some aspects have been described in relation to a device or system, these aspects should also be understood as a description of the corresponding method. For example, a block, device or functional aspect of the device or system may correspond to a feature, such as a method step, of the corresponding method. Accordingly, aspects described in relation to a method shall also be understood as a description of a corresponding block, a corresponding element, a property or a functional feature of a corresponding device or a corresponding system.

The following claims are hereby incorporated in the detailed description, wherein each claim may stand on its own as a separate example. It should also be noted that although in the claims a dependent claim refers to a particular combination with one or more other claims, other examples may also include a combination of the dependent claim with the subject matter of any other dependent or independent claim. Such combinations are hereby explicitly proposed, unless it is stated in the individual case that a particular combination is not intended. Furthermore, features of a claim should also be included for any other independent claim, even if that claim is not directly defined as dependent on that other independent claim.

What is claimed is:

1. A gaming device, comprising:

a control arrangement, comprising:

interface control circuitry configured to communicate with a user input interface;

credit meter control circuitry configured to control a credit meter; and at least one processor and a memory arrangement configured to store a plurality of instructions, which when executed by the at least one processor, causes the control arrangement to:

communicate data that results in a display, by a display device, of a play of a game comprising a display of a plurality of symbols at a plurality of symbol display positions of a plurality of reels, and display of a plurality of progression structures, wherein each progression structure comprises a plurality of steps, wherein each step is associated with a step credit value;

communicate data that results in a display, by the display device, of game-based progression along the steps of the plurality of progression structures based on the occurrence of symbol combinations of the plurality of symbols at at least one of the plurality of symbol display positions;

receive, via the interface control circuitry receiving a communication from the user input interface, credit value transfer information for causing a user-initiated update of a progression structure of the plurality of progression structures, wherein the credit value transfer information for causing a user-initiated update of a progression structure of the plurality of progression structures comprises progression structure identity information identifying one or more selected progression structures to be updated, the one or more selected progression structures to be updated comprising a user having selected one or more progression structures from amongst the plurality of progression structures, and step selection information identifying one or more steps to be updated of respective said one or more selected progression structures to be updated, said one or more steps to be updated of said respective one or more selected progression structures to be updated comprising a user having selected one or more steps from amongst the plurality of steps of said respective one or more selected progression structures to be updated; and communicate data that results in a display, by the display device, of the user-initiated update of the one or more selected progression structures based on the receiving, via the interface control circuitry receiving a communication from the user input interface, the credit value transfer information; and communicate data that causes the credit meter to update based on the receiving, via the interface control circuitry receiving a communication from the user input interface, the credit value transfer information.

2. The gaming device according claim 1, wherein the control arrangement is configured to cause the user-initiated update of the one or more selected progression structures independently of other progression structures of the plurality of progression structures.

3. The gaming device according to claim 1, wherein the step selection information comprises a quantity of steps of the one or more selected progression structures to be updated, the quantity of selected steps ranges from one to the total number of steps of the selected progression structure, wherein the control arrangement is configured to cause the user-initiated update of the selected progression structure by the quantity of steps.

4. The gaming device according to claim 1, wherein the control arrangement is configured to allow or decline the forward progression along the steps of the one or more selected progression structures based on a credit balance of the credit meter.

5. The gaming device according to claim 1, wherein the control arrangement is configured to cause user-initiated backward progression along the steps of at least one progression structure of the one or more selected progression structures, and user-initiated forward progression along the steps of at least one further progression structure of the one or more selected progression structures.

6. The gaming device according to claim 1, wherein a number of the one or more selected progression structures is less than the total number of progression structures of the plurality of progression structures.

7. The gaming device according to claim 1, wherein the control arrangement comprises:

progression determination circuitry configured to determine a progression status of respective progression structures of the plurality of progression structures, wherein the progression determination circuitry is coupled to the credit meter control circuitry and step credit control circuitry, wherein the credit meter control circuitry is configured to update the credit balance of the credit meter based on a credit signal from the progression determination circuitry, wherein the credit signal is based on the step selection information, and wherein the step credit control circuitry is configured to update a step credit balance of a step credit meter based on a step credit signal from the progression determination circuitry, wherein the step credit signal is based on the determined progression status of the respective progression structures.

8. The gaming device according to claim 1, wherein the control arrangement comprises game control circuitry configured to execute the play of the game, wherein the game control circuitry is configured to select a game condition from a plurality of game conditions for a subsequent play of the game based on a progression status of respective progression structures of the plurality of progression structures.

9. The gaming device according to claim 8, wherein each game condition of the plurality of game conditions is associated with a probability of occurrence of symbol combinations at the plurality of symbol display positions.

10. The gaming device according to claim 1, wherein the control arrangement comprises:

progression determination circuitry configured to determine a progression status of respective progression structures of the plurality of progression structures based on at least one of game-based progression and a user-initiated update, wherein the progression determination circuitry is configured to transmit a credit signal to the credit meter control circuitry if a backward progression is caused by the user-initiated update, and to refrain from transmitting the credit signal if a backward progression is caused by the occurrence of at least one regression symbol combination.

11. The gaming device according to claim 1, wherein the credit meter control circuitry is configured to update the credit balance of the credit meter based on whether a backward progression along the steps of the progression structure is caused by the occurrence of at least one regression symbol combination or by the user-initiated update.

12. The gaming device according to claim 1, wherein the control arrangement comprises:

display control circuitry configured to cause display of the play of the game, the updated credit balance and an updated step credit balance on the display device.

13. A method for operating a gaming device, the method comprising:

communicating data that results in a display, by a display device, of a play of a game comprising a display of a plurality of symbols at a plurality of symbol display positions of a plurality of reels, and display of a plurality of progression structures, wherein each progression structure comprises a plurality of steps, wherein each step is associated with a step credit value;

communicating data that results in a display, by a display device, of a game-based progression along the steps of the plurality of progression structures based on the occurrence of symbol combinations of the plurality of symbols at at least one of the plurality of symbol display positions;

receiving, via interface control circuitry receiving a communication from a user input interface of the interface control circuitry, credit value transfer information for causing a user-initiated update of a progression structure of the plurality of progression structures, wherein the credit value transfer information for causing a user-initiated update of a progression structure of the plurality of progression structures comprises progression structure identity information identifying one or more selected progression structures to be updated, the one or more selected progression structures to be updated comprising a user having selected one or more progression structures from amongst the plurality of progression structures, and step selection information identifying one or more steps to be updated of respective said one or more selected progression structures to be updated, said one or more steps to be updated of said respective one or more selected progression structures to be updated comprising a user having selected one or more steps from amongst the plurality of steps of said respective one or more selected progression structures to be updated; and communicating data that results in a display, by the display device, of the user-initiated update of the selected progression structure based on the receiving, via the interface control circuitry receiving a communication from the user input interface, the credit value transfer information; and communicating data the causes a credit meter to update based on the receiving, via the interface control circuitry receiving a communication from the user input interface, the credit value transfer information.

14. The method according to claim 13, comprising causing the user-initiated update of the one or more selected progression structures independently of other progression structures of the plurality of progression structures.

15. Computer-readable storage medium storing a plurality of instructions, which when executed by a processor, causes the processor to:

communicate data that results in a display, by a display device, of a play of a game comprising a display of a plurality of symbols at a plurality of symbol display positions of a plurality of reels, and display of a plurality of progression structures, wherein each progression structure comprises a plurality of steps, wherein each step is associated with a step credit value;

communicate data that results in a display, by a display device, of a game-based progression along the steps of the plurality of progression structures based on the occurrence of symbol combinations of the plurality of symbols at at least one of the plurality of symbol display positions, receive, via interface control circuitry receiving a communication from a user input interface of the interface control circuitry, credit value transfer information for causing a user-initiated update of a progression structure of the plurality of progression structures, wherein the credit value transfer information for causing a user-initiated update of a progression structure of the plurality of progression structures comprises progression structure identity information identifying one or more selected progression structures to be updated, the one or more selected progression structures to be updated comprising a user having selected one or more progression structures from amongst the plurality of progression structures, and step selection information identifying one or more steps to be updated of respective said one or more selected progression structures to be updated, said one or more steps to be updated of said respective one or more selected progression structures to be updated comprising a user having selected one or more steps from amongst the plurality of steps of said respective one or more selected progression structures to be updated; and communicate data that results in a display, by the display device, of the user-initiated update of the selected progression structure based on the receiving, via the interface control circuitry receiving a communication from the user input interface, the credit value transfer information; and communicate data that causes a credit meter to update based on the receiving, via the interface control circuitry receiving a communication from the user input interface, the credit value transfer information.

* * * * *